United States Patent [19]

Hidden et al.

[11] 4,160,629

[45] Jul. 10, 1979

[54] LIQUID IMMERSIBLE SCROLL PUMP

[75] Inventors: William P. Hidden, Wenham; John E. McCullough, Carlisle, both of Mass.

[73] Assignee: Arthur D. Little, Inc., Cambridge, Mass.

[21] Appl. No.: 807,414

[22] Filed: Jun. 17, 1977

[51] Int. Cl.[2] ..... F04C 1/02

[52] U.S. Cl. ..... 418/55

[58] Field of Search ..... 418/48, 55

[56] References Cited

U.S. PATENT DOCUMENTS

| | | | |
|---|---|---|---|
| Re. 29,445 | 10/1977 | Nusser | 417/366 |
| 3,175,758 | 3/1965 | Dirk | 417/366 X |
| 3,418,991 | 12/1968 | Shultz et al. | 417/366 X |
| 3,567,348 | 3/1971 | Benson | 418/48 |
| 3,884,599 | 5/1975 | Young et al. | 418/55 |
| 3,994,633 | 11/1976 | Shaffer | 418/55 X |

FOREIGN PATENT DOCUMENTS

| | | | |
|---|---|---|---|
| 976187 | 3/1951 | France | 418/55 |

*Primary Examiner*—Carlton R. Croyle
*Assistant Examiner*—Leonard E. Smith
*Attorney, Agent, or Firm*—Bessie A. Lepper

[57] ABSTRACT

A liquid immersible scroll pump in which all of the pump components including electric motor drive means are contained within a housing and through which the liquid is pumped at a controlled predetermined pressure. Hydraulic pressure within the pump provides sufficient axial force on the scroll members to enhance radial sealing as well as the tangential sealing of the flanks of the scroll wraps. The pump is particularly suited for low-cost mass production and may be used as a fuel pump, either immersed in the fuel tank of an automobile or mounted outside the tank, to provide fuel under pressure through a line to the engine.

53 Claims, 35 Drawing Figures

LIQUID IMMERSIBLE SCROLL PUMP

This invention relates to scroll-type liquid pumps and more particularly to scroll liquid pumps which may be immersed in the liquid being pumped.

For some pumping operations it is desirable that the pump performing the pumping be immersed in the liquid being pumped. Although there has not, heretofore, been any great demand for such pumps, there has recently arisen a real need for a small pump which can be located within the fuel tank of an automobile or other self-propelled vehicle using a relatively light cut of fuel. To be effective, such a pump must be totally immersible in the fuel, e.g., gasoline or diesel fuel, being pumped. The recently developed need for a pump of this character is brought about through the requirement for installation of emission control devices, the use of which leads to the development of higher temperatures under the hood where fuel pumps have previously been located. These higher temperatures cause vapor locking of the fuel pump, a problem which is most readily solved by placing the fuel pump in the fuel tank to isolate it from excessive temperature, and connecting the fuel pump to the engine through a pressurized fuel line.

Since the use of a pump located in the fuel tank of an automobile places about as stringent requirements on a liquid-immersible pump as any conceivable use, the following detailed description of the pump of this invention will be presented in terms of its use for that application. It will, however, be appreciated that the pump of this invention may be used with liquids other than fuel oil, may be operated in an environment other than the liquid being pumped, and may be any convenient size, e.g., much larger than that which meets the rigid size restrictions placed on it by its location within an automobile fuel tank, for example.

Moreover, the development of electronically controlled fuel metering systems intended to enhance engine operating efficiency has imposed additional demands on the fuel pump. Such systems require high fuel delivery pressures which cannot conveniently be produced by a simple centrifugal pump—the type heretofore used for in-tank applications.

Among those requirements which a fuel tank pump must meet for use in a passenger automobile are the ability to operate reliably and efficiently without maintenance for extended periods of time, e.g., 2000 hours, to deliver 185 pounds or about 31 gallons (84 kilograms or about 120 liters) of fuel per hour at 12 psig, to operate with a 12-volt D.C. motor with maximum current of 6.3 amp, and to run dry in an empty tank for at least ten minutes. Moreover, it must be self-priming, must operate with minimum noise, vibration and output flow variation, must fit through an automobile fuel tank access opening which means its maximum diameter must be no greater than $1\frac{7}{8}$ inches (4.76 cm), and it must be low in cost to manufacture. It is immediately apparent that the commonly used types of pumps—centrifugal or conventional positive displacement pumps—probably would not be able to meet all of these requirements. It is therefore necessary to look to some other type of pump for this purpose. It has now been found that a scroll-type liquid pump can be used to meet all of the above-listed requirements and to provide, in addition, very important advantages.

There is known in the art a class of devices generally referred to as "scroll" pumps, compressors and engines wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls to form one or more fluid volumes or pockets. The angular position of these pockets varies with relative orbiting of the spiral centers; and all pockets maintain the same relative angular position. As the contact lines shift along the scroll surfaces, the pockets thus formed experience a change in volume. In compressors and expansion engines there are thus created zones of lowest and highest pressures which are connected to fluid ports. In liquid pumps the volume ratio remains unity throughout. The outermost and innermost pockets are connected to liquid ports, and the flow of liquid may be either outwardly from the innermost pocket or inwardly from the outermost pocket. For convenience the flow in either case may be generally referred to as radial, although it takes on a spiral-like pattern.

As early patent to Creux (U.S. Pat. No. 801,182) describes scroll-type apparatus in general. Among the prior art patents disclosing scroll apparatus, a number of them have mentioned the interchangeable use of such devices as compressors, expanders and pumps. Several prior art patents have been directed either wholly or in part to scroll devices as liquid pumps (see for example U.S. Pat. Nos. 2,841,089, 2,921,534, 3,600,114 and 3,817,664). Even though this type of liquid pump has been known for a relatively long time, the scroll pump has not been able to compete with centrifugal pumps or with such positive displacement pumps as those incorporating pistons or rotary elements. This is apparently primarily due to the fact that scroll pumps of the prior art develop very high pressure pulses. Thus, despite the inherent advantages which may be associated with scroll liquid pumps (minimal sealing problem, compactness, good efficiency, reliable long-term operation, etc.), these advantages have heretofore not been realized in practice in the form of commercially acceptable devices because scroll liquid pumps could not be made to operate at reasonable speeds (e.g., at least 1800 rpm) in an essentially pulsation-free manner.

In a copending application Ser. No. 807,413, now U.S. Pat. No. 4,129,405 of John E. McCullough filed concurrently herewith and assigned to the same assignee as this application, there is disclosed a scroll liquid pump incorporating a unique porting system which makes it possible to achieve essentially pulsation-free operation of a scroll liquid pump. According to this disclosure, there are provided mating scroll members suitable for incorporation into a scroll liquid pump, comprising in combination a stationary scroll member having a central liquid port and comprising a stationary end plate, a stationary involute wrap of one and one-half involute turns affixed to one surface of the stationary end plate, and stationary recessed liquid transfer passage means cut in the surface of the stationary end plate; and an orbiting scroll member arranged to be orbited with respect to the stationary scroll member by driving means and comprising an orbiting end plate, an orbiting involute wrap of one and one-half involute turns affixed to the surface of the orbiting end plate, and orbiting recessed liquid transfer passage means cut in the surface of the orbiting end plate. When the orbiting scroll member is driven by the driving means, the stationary and orbiting involute wraps define moving liquid pockets of variable volume, a peripheral volume around the pockets and a central liquid zone. The stationary and orbiting recessed liquid transfer passage means are located and configured to be opened substantially immediately after the orbiting involute wrap has reached that point in its orbiting cycle to define three essentially completely sealed-off liquid zones and to remain open at least until the liquid passages between the wraps are sufficiently large to prevent any substantial pressure pulsations within the scroll liquid pump in which the scroll members are incorporated. The liquid transfer passage means may be an inner passage, an outer passage or a combination of inner and outer passages depending upon their location with respect to the involute wraps. A scroll liquid pump incorporating these mating scroll members is also disclosed in U.S. Ser. No. 807,413 now U.S. Pat. No. 4,129,405; and it comprises axial force applying means arranged to urge the scroll members into axial contact; coupling means to maintain the scroll members in fixed angular relationship; liquid inlet conduit means and liquid discharge conduit means; and driving means for orbiting the orbiting scroll member. The flanks of the involute wraps along with the end plates on which the involute wraps are mounted define moving liquid pockets of variable volume, a peripheral volume around the pockets and a central liquid zone. The liquid inlet and discharge conduit means may be in communication with the inner liquid pocket or the peripheral volume thus making it possible to operate the scroll liquid pump with the liquid flow being either radially inward or outward.

The solution disclosed in the above-identified application to the pressure-pulsation problems previously encountered in scroll liquid pumps now makes it possible to provide a wide variety of scroll pumps, among which is the scroll pump of this invention particularly suitable as an immersible fuel pump.

It is therefore a primary object of this invention to provide a unique scroll liquid pump. It is another object of this invention to provide a scroll liquid pump of the character described which is particularly suitable for immersion in the liquid being pumped. It is yet another object to provide a scroll liquid pump which can be used as a fuel pump for self-propelled vehicles using the lighter cuts of fuel oil and which can be placed in the fuel tanks, thus being isolated from excessive temperatures which may be encountered in vehicles having emission control devices.

A further object is to provide a scroll liquid pump which is capable of producing high fuel delivery pressures, which is self-priming, which operates essentially free from noise, vibration and output flow variation, which can run dry for a period of time, which requires no valves and which can ingest debris without permanent damage. A still further object is to provide a scroll liquid pump of the character described which provides self-actuating scroll sealing, experiences minimum friction losses, operates reliably over extended periods of time and is low in cost. Other objects of the invention will in part be obvious and will in part be apparent hereinafter.

According to one aspect of this invention there is provided a liquid immersible scroll pump, comprising in combination housing means defining a chamber therein and having liquid inlet means on one end thereof and liquid discharge means on the other end thereof; stationary and orbiting scroll members having, respectively, stationary and orbiting end plates presenting facing surfaces, said scroll members having porting means arranged to prevent the development of any appreciable pressure pulsations during pumping and being located within said chamber in liquid receiving relationship to said liquid inlet means; coupling means to maintain said stationary and orbiting scroll members in a predetermined angular relationship; and driving means, including motor means for driving said orbiting scroll member, located within said chamber between said scroll members and said other end of said housing, whereby liquid pumped radially outward by said scroll members and through said pump flows around said driving means and maintains a predetermined hydraulic pressure within said chamber to provide axial loading on said scroll members.

In those embodiments of the pump which are required to deliver liquid under moderate to high pressures, axial compressive load carrying means will also be incorporated. The functions of the coupling means and the load carrying means may be incorporated in a single component.

The invention accordingly comprises the features of construction, combinations of elements, and arrangement of parts which will be exemplified in the constructions hereinafter set forth, and the scope of the invention will be indicated in the claims.

For a fuller understanding of the nature and objects of the invention, reference should be had to the following detailed description taken in connection with the accompanying drawings in which FIG. 1 is an enlarged longitudinal cross section of a scroll liquid pump constructed in accordance with this invention and which is particularly suited as a fuel pump for an automobile;

Figure 25:
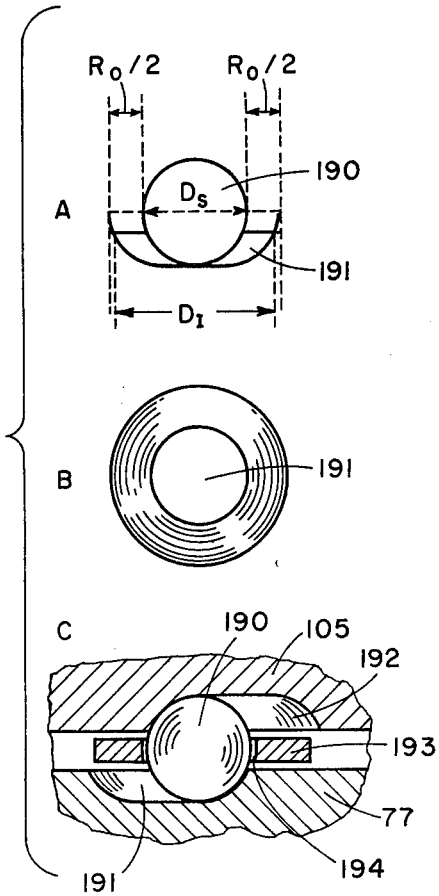
Figure 24:
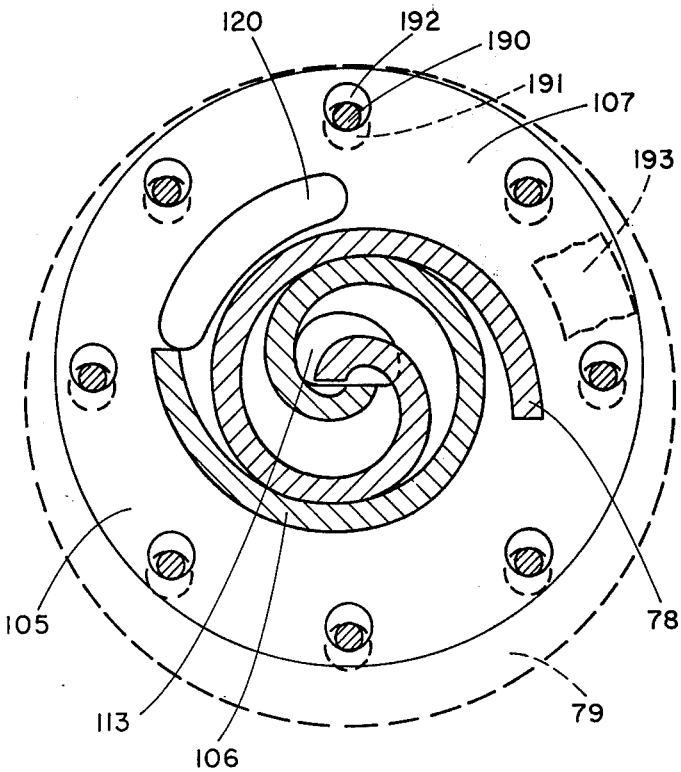
FIG. 24 is a cross section of the apparatus of FIG. 23 taken through plane 24—24 of FIG. 23 and illustrating the respective positioning of the ball thrust bearings used.
Figure 26:
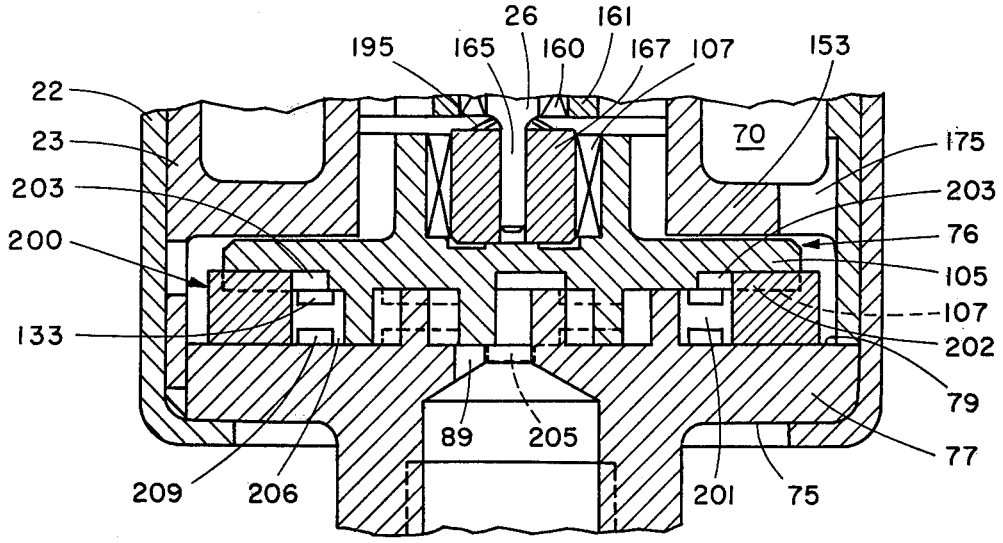
Figure 27:
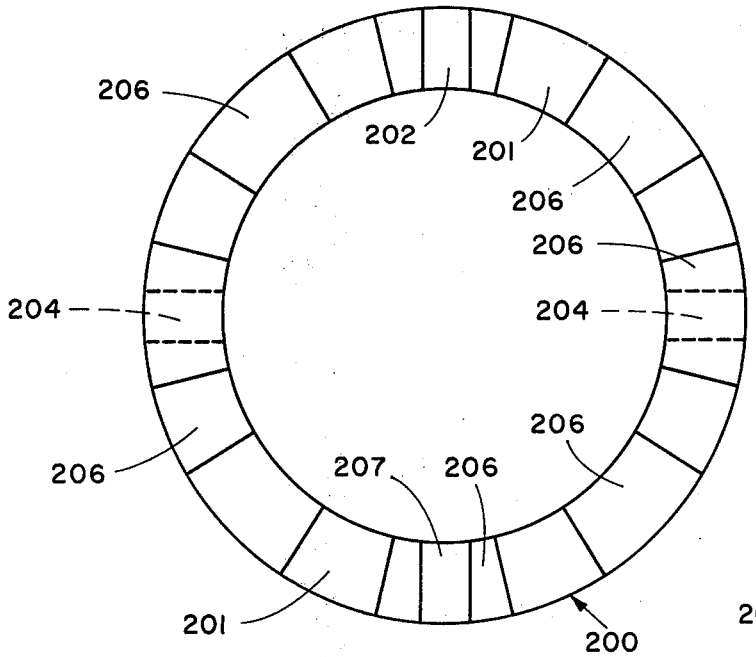
Figure 28:
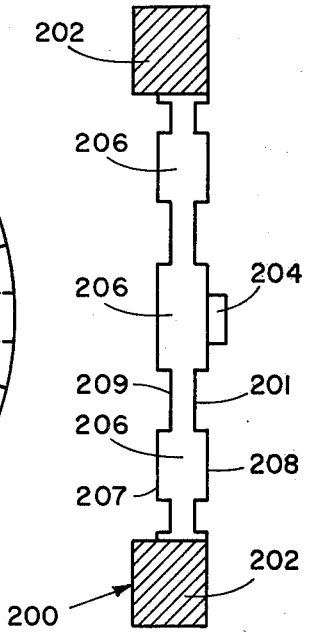
Figure 35:
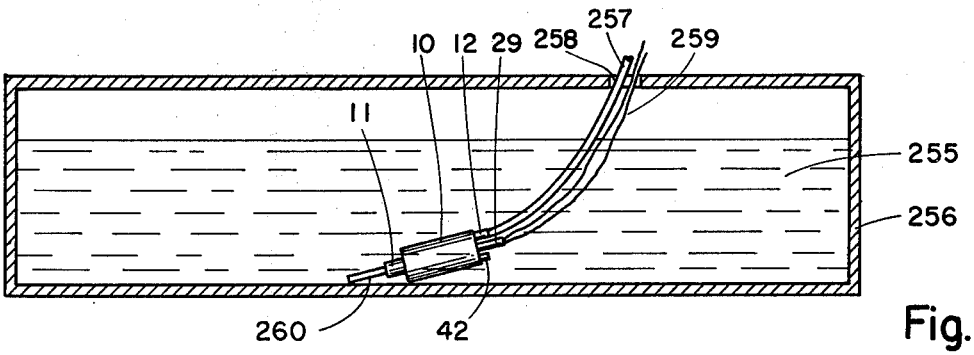
Figure 29:
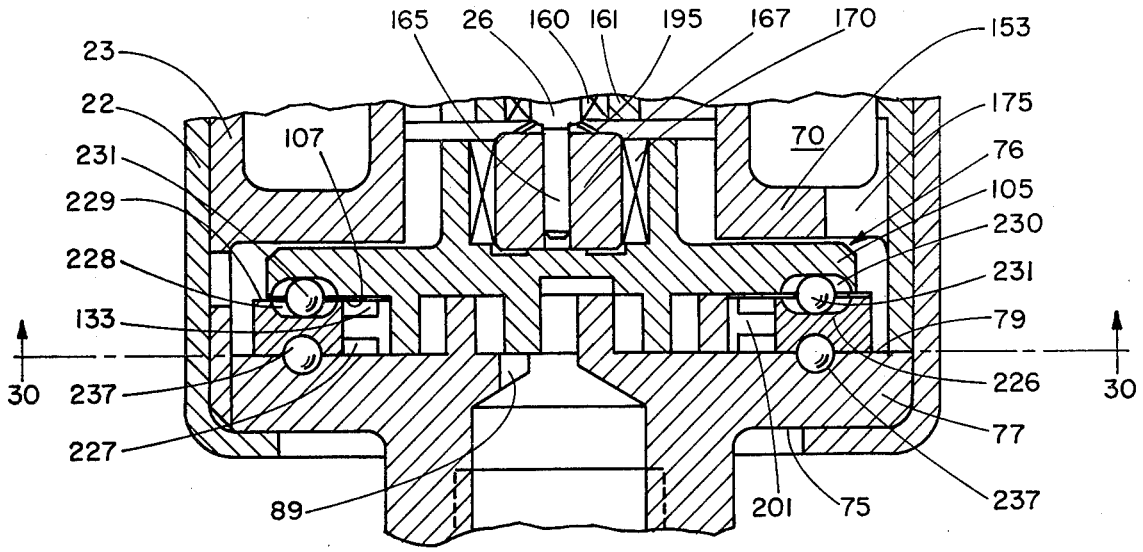
Figure 30:
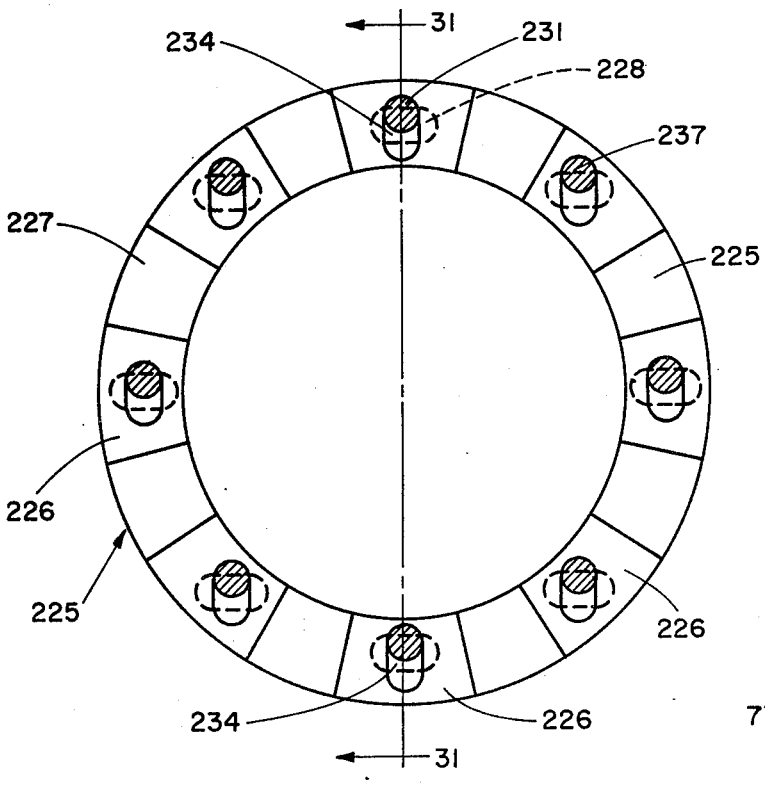
Figure 31:
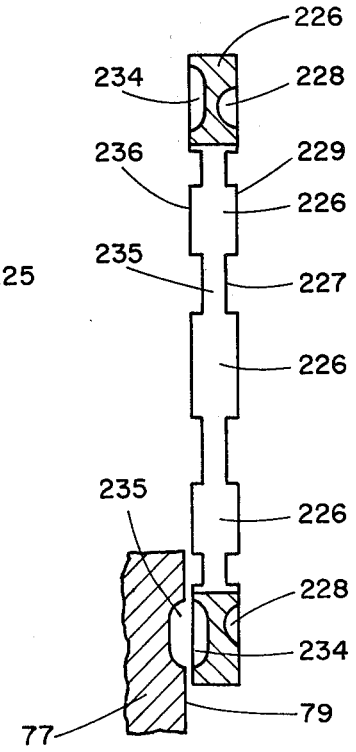
Figure 32:
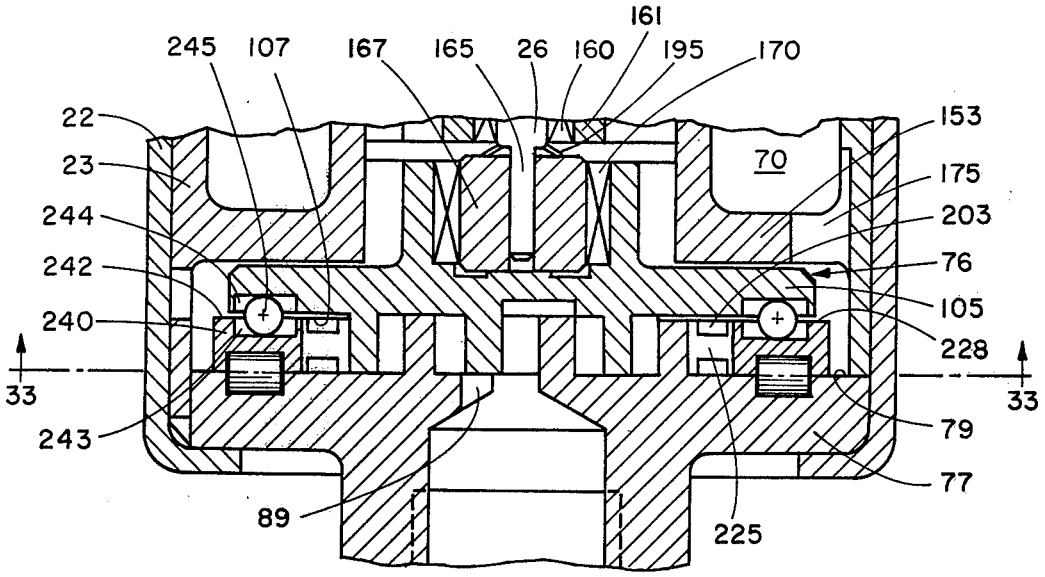
Figure 33:
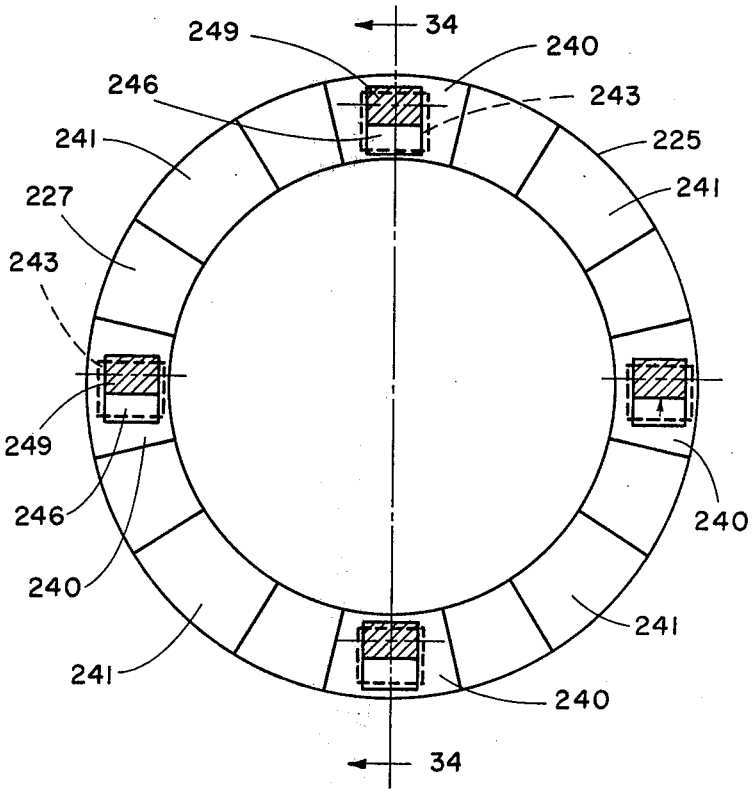
Figure 34:
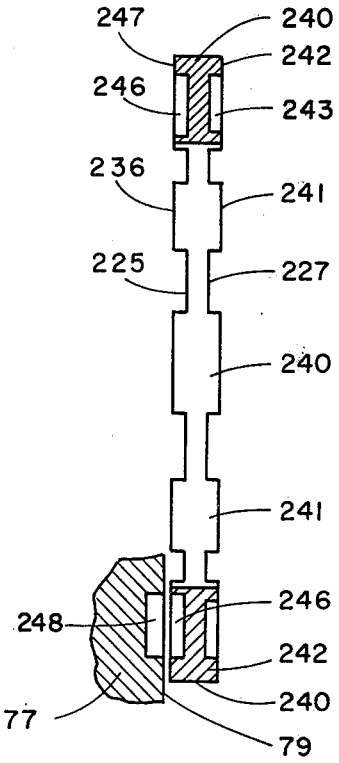

FIG. 25 presents details in diagrammatic plan and cross sectional views of the factors involved in the use of the ball thrust bearings of FIGS. 24 and 25;

FIG. 26 illustrates another embodiment of an axial load carrying means and coupling member combined in one apparatus component;

FIGS. 27 and 28 are plane and cross sectional views, respectively, of the axial load carrying/coupling means used in FIG. 25;

FIG. 29 illustrates yet another embodiment of a combined axial load carrying/coupling means in which spherical members serve in the dual function of load carrying and coupling;

FIGS. 30 and 31 are plane and cross sectional views, respectively, of the axial load carrying/coupling means of FIG. 29;

FIG. 32 illustrates a modification of the axial load carrying/coupling means of FIG. 29 in which rollers serve in the dual function of load carrying and coupling;

FIGS. 33 and 34 are plane and cross sectional views, respectively, of the axial load carrying/coupling means of FIG. 32; and FIG. 35 is a cross sectional view of a tank containing liquid in which the pump of this invention is immersed.

The principles of the operation of scroll apparatus have been presented in previously issued patents. (See for example U.S. Pat. No. 3,884,599.) It is therefore unnecessary to repeat a detailed description of the operation of such apparatus. It is only necessary to point out that a scroll-type apparatus operates by moving a sealed pocket of fluid taken from one region into another region which may be at a different pressure. If the fluid is a liquid, the fluid volume remains essentially constant independent of pressure, and the apparatus serves as a pump.

The sealed pocket of fluid within the scroll apparatus is bounded by two parallel planes defined by end plates, and by two cylindrical surfaces defined by the involute of a circle or other suitably curved configuratin. The scroll members have parallel axes since in only this way can the continuous sealing contact between the plane surface of the scroll members be maintained. A sealed pocket moves between these parallel planes as the two lines of contact between the cylindrical surfaces move. The lines of contact move because one cylindrical element, e.g., a scroll member, orbits within the other. This is accomplished, for example, by maintaining one scroll member stationary and orbiting the other scroll member. Pumping is achieved by this mechanism in the pump of this invention and hence the pump is referred to as a scroll liquid pump.

Figure 1:
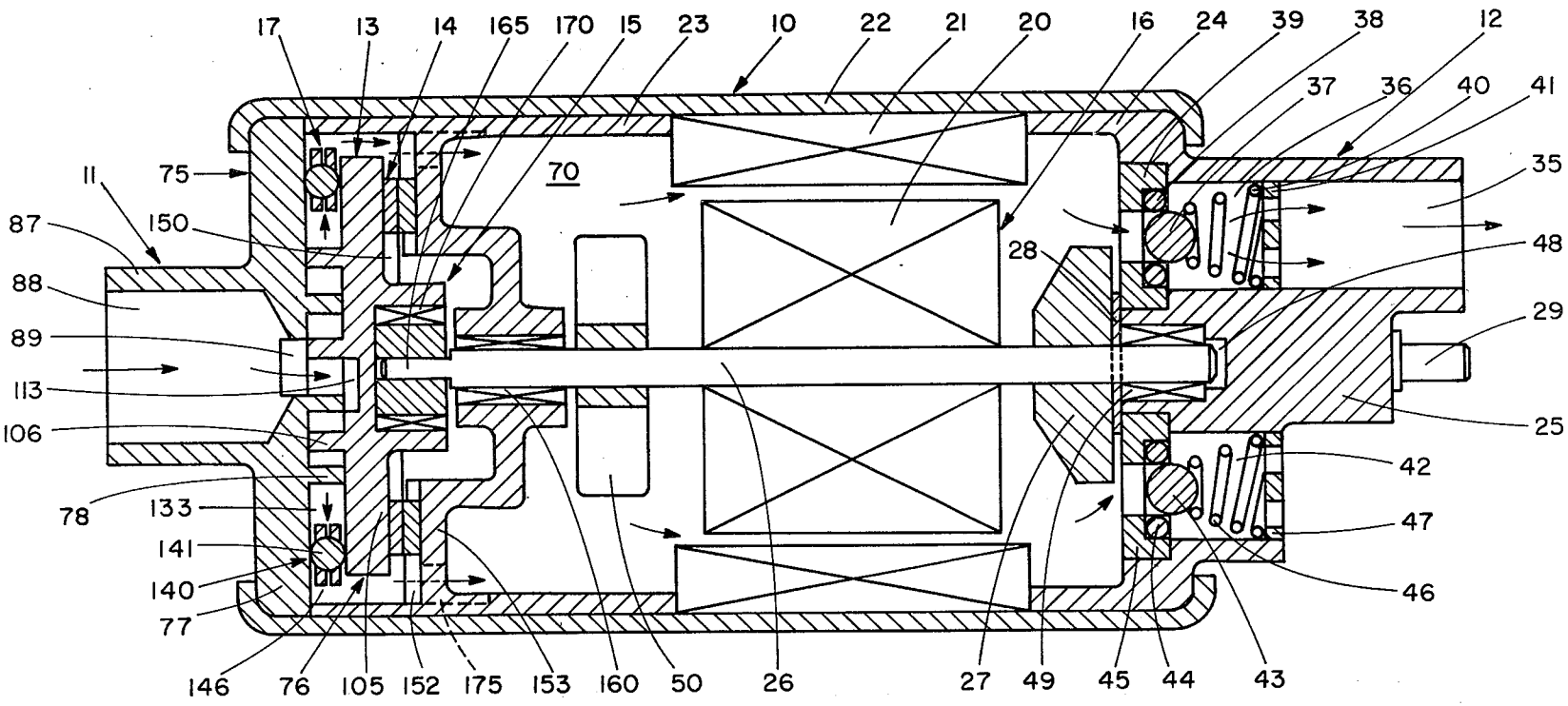

One embodiment of the scroll liquid pump of this invention is illustrated in FIG. 1 in longitudinal cross section. The pump comprises a main housing 10, liquid inlet means 11, liquid discharge means 12, scroll pumping means 13, coupling means 14, orbiting scroll driving means 15, motor means 16, and axial load carrying means 17. In the following detailed description of the pump of this invention, it will be convenient to describe first the motor means and the liquid discharge means inasmuch as these components of the pump are of more-or-less conventional design. The motor means 16 is an electric motor comprising an armature 20 and stator magnets 21 positioned and held within the central housing section 22 between bearing housing 23 (described below) and skirt 24 of discharge end block 25. Armature 20 is mounted on drive shaft 26 as is also face commutator 27, which contacts carbon brushes 28 to which electrical contact is made through oppositely disposed screw terminals 29 extending externally of the pump housing (see also FIG. 2).

Liquid discharge means 12 comprises a discharge conduit 35 in end block 25 and it has a check valve 36 to prevent the reverse flow of liquid through the pump when the pump is not operational and during start up. Check valve 36 is shown in FIG. 1 to comprise a ball 37 seated on an elastomeric ring 38, supported on an annular ring support 39, and held under an axial force by spring 40 held within conduit 35 by means of a ported plate 41. Spring 40 is, of course, chosen to permit valve 36 to open under a predetermined liquid pressure, e.g., about one psig for a fuel pump in an automobile gasoline tank. A pressure relief valve 42 is also provided. It is shown in FIG. 1 to be of a construction similar to discharge valve 36, comprising a ball 43, seating ring 44, ring support 45, spring 46 and ported spring retaining plate 47. Spring 46 will be of appropriate strength to maintain relief valve 42 closed until a predetermined maximum liquid pressure, e.g., about 12 psig, is reached within the housing. It is, of course, within the scope of this invention to use any suitably configured valve means for discharge and relief valves 36 and 42, those shown in FIG. 1 being illustrative only.

Drive shaft 26 terminates within a central well 48 in discharge end block 25 and is supported and aligned through shaft bearing 49. A primary counterweight 50 is mounted on shaft 26 to counteract the forces generated transverse to the pump axis because of the eccentricity of the orbiting components. It is therefore necessary to provide a secondary counterweight means to achieve full dynamic balance by canceling out the moment generated by primary counterweight 50. In the embodiment illustrated in FIG. 1 this secondary counterweight may be provided either by incorporating suitably positioned weights in face commutator 27 or by providing suitable weight distribution in armature 20.

Figure 3:
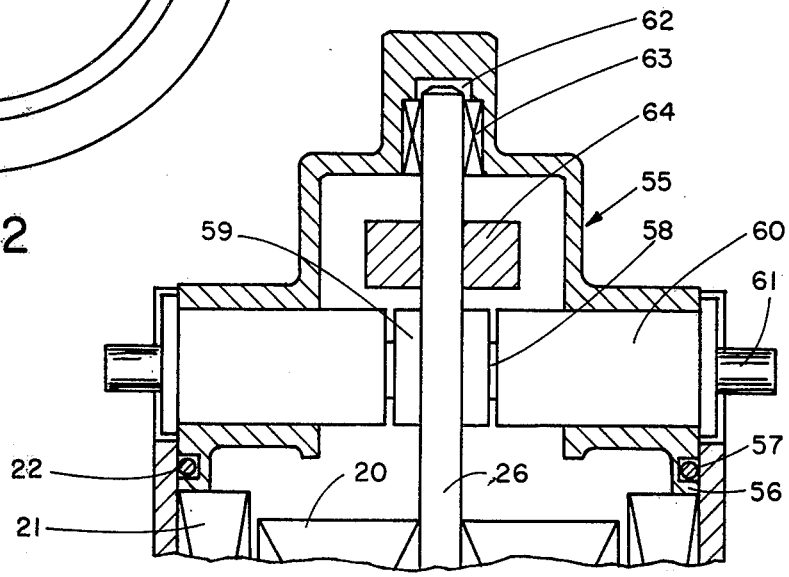
FIG. 3 is a partial longitudinal cross section of a modification of the pump of FIG. 1 illustrating an alternate means of providing electrical connections with the motor and of providing a secondary counterweight.
Figure 4:
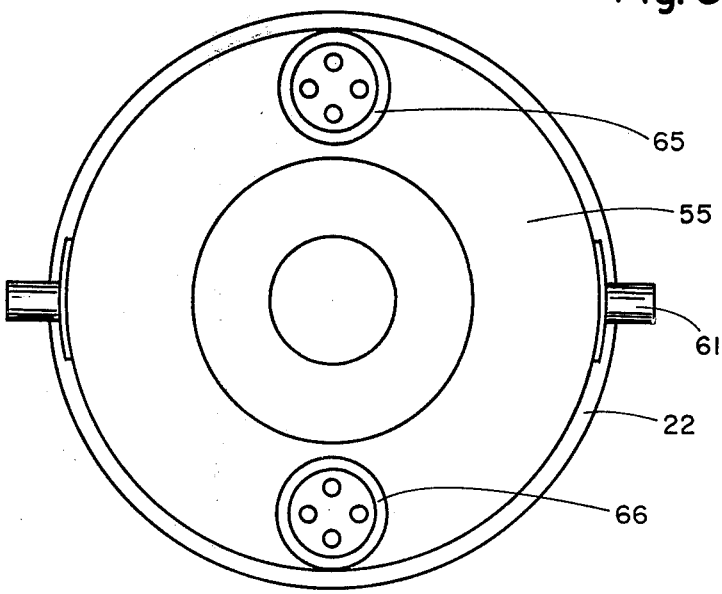
FIG. 4 is a plan view of the discharge end of the pump of FIG. 3.

FIGS. 3 and 4 illustrate another embodiment of the discharge end block of the pump and of means to make electrical connections with the motor. The discharge end block 55 is of stepped configuration terminating internally within the pump in a skirted ring 56 sealed to central housing section 22 through a sealing ring 57. Ring 56 serves to hold magnets 21 within the pump. The carbon brushes 58, making contact with commutator 59, are held by oppositely disposed brush holder 60 which extend through discharge end block 55 for connection with terminals 61. Drive shaft 26 terminates in well 62 and is aligned and supported by bearing 63.

Figure 2:
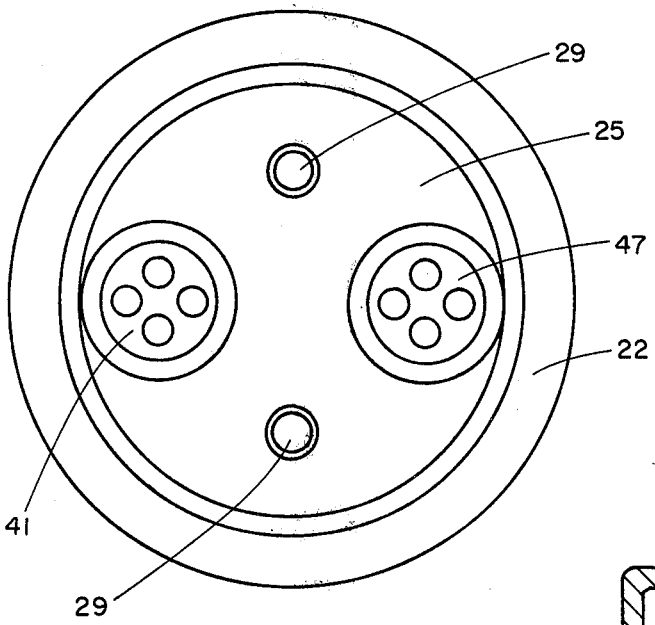
FIG. 2 is a plan view of the discharge end of the pump of FIG. 2.

In the embodiment of FIG. 3, a separate secondary counterweight 64 is mounted on shaft 26. As will be seen in the top plan view of FIG. 4, a valve-controlled discharge conduit 65 and pressure relief valve 66, similar in construction to that described in conjunction with FIGS. 1 and 2, are provided for the embodiment of FIG. 3.

The flow of liquid through the pump is shown by arrows in FIG. 1. Liquid enters inlet means 11, is pumped by the scroll pump 13 from scroll pump chamber 146 into motor chamber 70, defined within the volume of housing 10, to flow around the motor and out through valve 36. The liquid pumped thus serves as a lubricant and coolant for the pump components.

The scroll pump, the porting system, axial load carrying means, coupling means and drive mechanism for the scroll pump are illustrated in detail in FIGS. 6–28 in which the same reference numerals are used to refer to the same elements.

Figure 5:
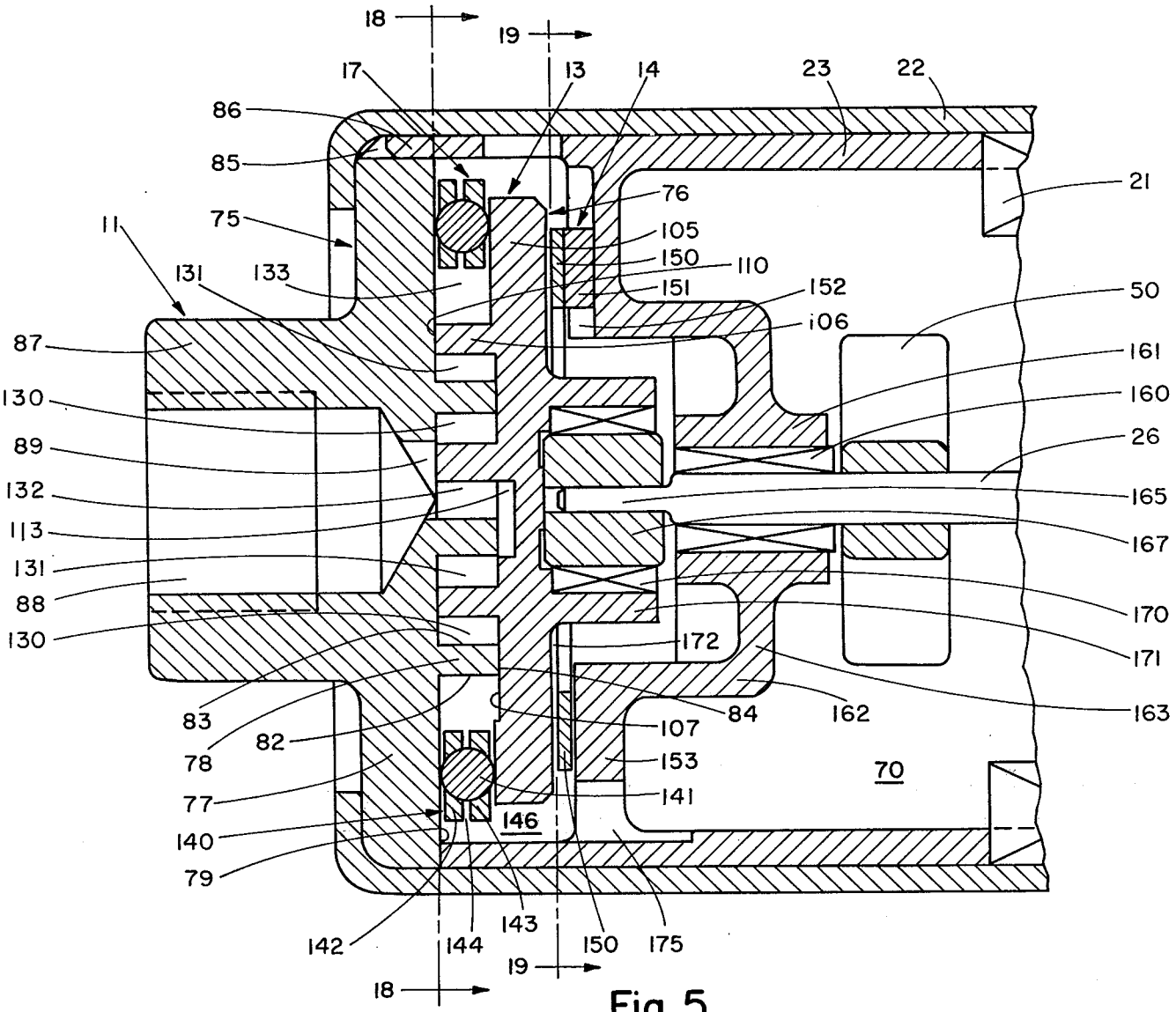
FIG. 5 is an enlarged longitudinal cross section of the inlet end of the scroll liquid pump of this invention illustrating in detail the driving and coupling means, the scroll members, the porting system and the axial load carrying means.
Figure 6:
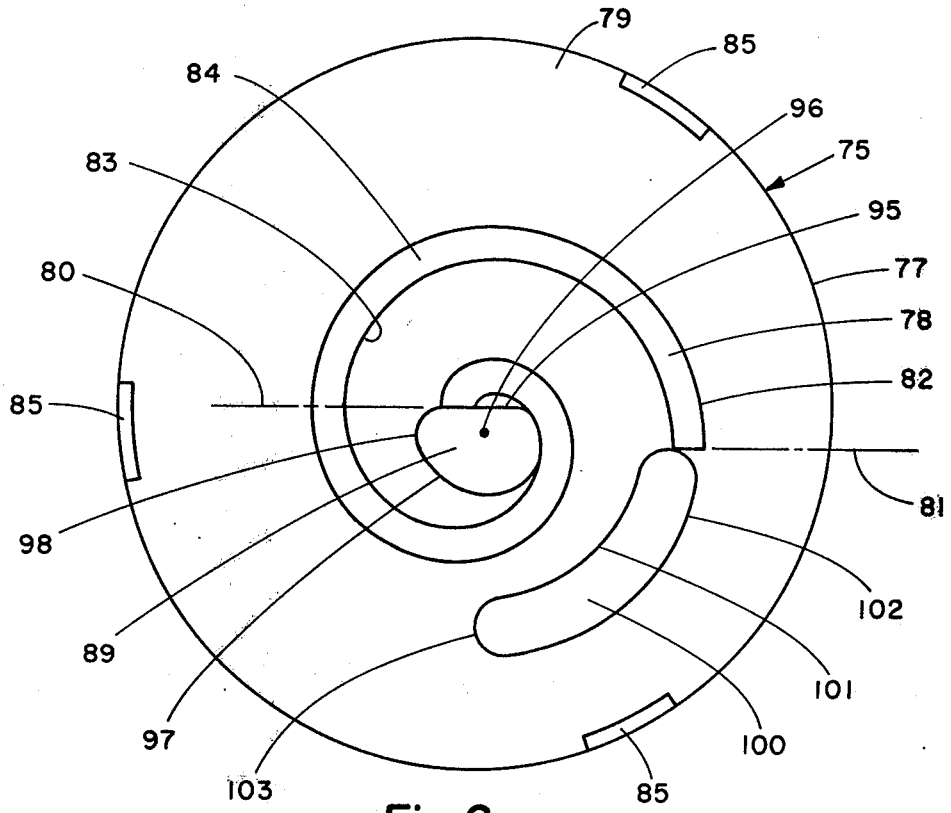
FIG. 6 is an end view of the stationary scroll member of the pump of FIG. 5.
Figure 7:
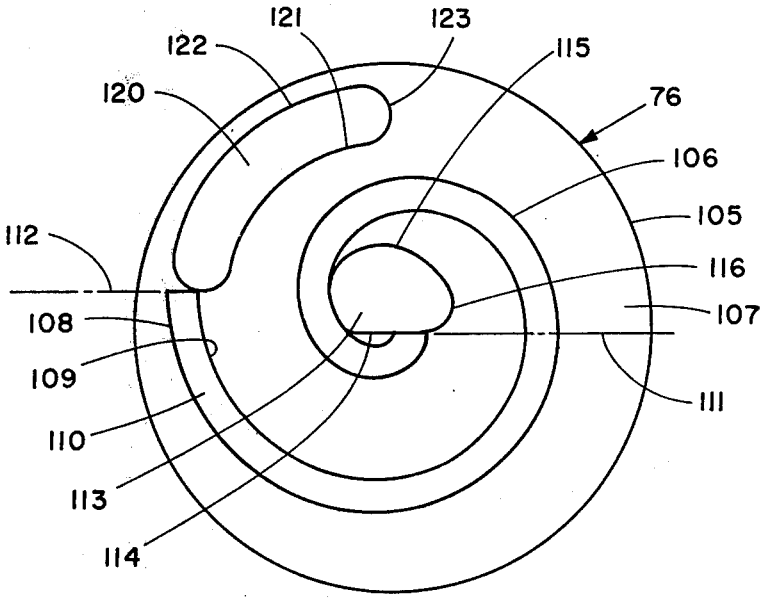
FIG. 7 is an end view of the orbiting scroll member of the pump of FIG. 5.

As will be seen in FIGS. 5–7, scroll pump 13 comprises a stationary scroll member 75 and orbiting scroll member 76. Stationary scroll member 75 is comprised of an end plate 77 and an involute wrap 78 integral with or mounted on a separate member on the inner or facing surface 79 of end plate 77 (see for example U.S. Pat. No. 3,994,635). Involute wrap 78 begins at a line of contact 80 (FIG. 6) which is drawn as a tangent to the involute generating radius and through the points of contact between the involutes of the fixed and orbiting scroll members, and it ends at a line of contact 81 which is also drawn as a tangent to the involute generating radius. Thus this wrap is formed of one and one-half turns of the involute; and it has an outer flank surface 82, an inner flank surface 83 and an end surface 84. A scroll liquid pump must be constructed to that each of the scroll members has a wrap of one and one-half turns of an involute. This requirement is dictated by the fact that a scroll device designed to pump a liquid must have a compression ratio of exactly one. If the scroll apparatus had a compression ratio greater than one, it would attempt to compress the trapped liquid. Since liquids are essentially incompressible, any scroll pump operating with a compression ratio greater than one would jam and malfunction. Thus, in order for a scroll pump to have a compression ratio of one the members must have no more than one and one-half wraps of involute. This length of wrap achieves the desired continuity of seal between the peripheral zone and interior zone defined between the scroll members without compressing any of the trapped fluid. Uniformly spaced keyways 85 are cut in the periphery of end plate 77 to engage keys 86 (FIG. 5) affixed to the internal wall of bearing housing section 23 and to maintain the stationary scroll member fixed within the pump.

End plate 77 of the stationary scroll member serves as the inlet end of the pump housing and has a central boss 87 (FIG. 5) defining an inlet conduit 88 in liquid communication, through a central port 89 in end plate 77, with the central zone of the scroll pump. As will be seen in FIG. 6, central port 89 is configured to have one principal boundary 95 coinciding with line of contacts 80 and 81 or with a line which passes through the center 96 of end plate 77 and parallel to lines of contact 80 and 81, and another principal curved boundary 97 which conforms in configuration to the outer surface 108 of the involute wrap 106 of the orbiting scroll element 76 (FIG. 7) when the two scroll elements are oriented such that the maximum of four contact points between the flanks of the wraps is achieved as shown in the orientation of the wraps in FIG. 8. Thus curved boundary 97 may be defined as a partial tracing of an involute wrap edge of the mating scroll element. These principal boundaries are joined through blending radii 98. Although central port 89 may be semicircular rather than having an involute boundary 97, the involute configuration illustrated is preferred for more accurate porting. Alternatively, the central port 89 in the orbiting scroll member 75 may be circular in configuration and may include a recessed liquid passage, of the configuration specified for central port 89, in communication therewith as illustrated in FIGS. 1 and 2 of U.S. Ser. No. 807,413.

Figure 8:
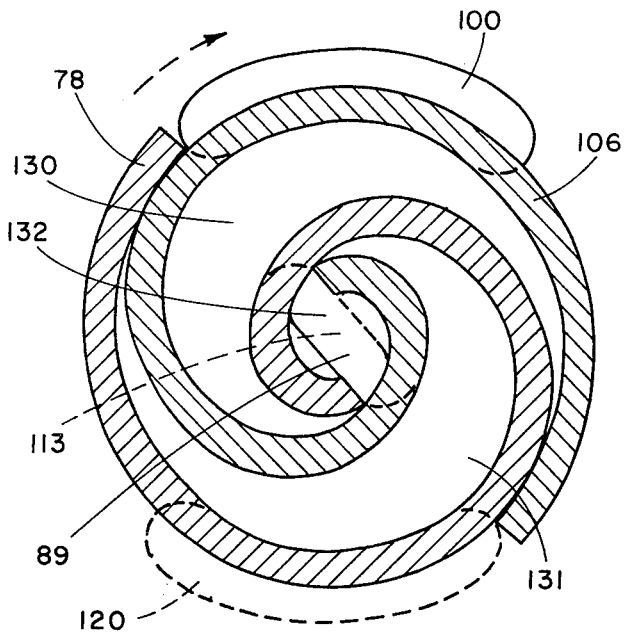
FIGS. 8–17 are alternating transverse and longitudinal cross sections of the stationary and orbiting scroll members of the pump of FIG. 5 illustrating the operation of the porting system of the pump.

To complete the porting system of the stationary scroll member it has a recessed transfer passage 100 in facing surface 79 of end plate 77. As shown in FIG. 6, transfer passage 100 has a principal inner boundary 101 conforming in configuration to the inner surface 109 of the involute wrap 106 of the orbiting scroll member (FIG. 7) when the two scroll members are oriented such that the maximum of four contact points between the flanks of the wraps is achieved as shown in FIG. 8. Thus this principal boundary 101, like boundary 97 of central port 89, represents a partial tracing of an involute wrap edge of the mating scroll member. The second principal or outer boundary 102 of transfer passage 100 is cut to follow the contour of inner boundary 101 and is spaced radially outward therefrom. Boundaries 101 and 102 are joined through blending radii 103. The distance between boundaries 101 and 102 is preferably about twice the thickness of involute wrap 78, and the depth of recessed transfer passage 100 is preferably about equal to the thickness of the involute wrap. Transfer recessed passage 100 is thus of general arcuate configuration and is cut to be contiguous with or spaced a short distance from the outer end of wrap 78 and extending through an arc ranging between about 45 and 90 degrees. Since transfer passage 100 is located outside the involute wrap it may, for convenience, be referred to as an "outer" passage.

As will be seen in FIG. 7, the orbiting scroll member 76 has a configuration similar to that of the stationary scroll member 75. The orbiting scroll member 76 is formed of an end plate 105 and an involute wrap 106 affixed to or integral with the inner surface 107 of end plate 105. Wrap 106 has an outer flank surface 108, and inner flank surface 109 and an end surface 110. Involute wrap 106 begins at a line of contact 111 which is drawn as a tangent to the involute generating radius and through the points of contact between the involutes of the stationary and orbiting scroll elements, and it ends at a line of contact 112 which is also drawn as a tangent to the involute generating radius. Thus the wrap of the orbiting scroll member is also one and one-half involute turns. A recessed transfer passage 113 is cut into the surface 107 of the end plate of the orbiting scroll element, its location and configuration bearing the same relationship to the stationary scroll element as central port 89 of the stationary element bears to the orbiting scroll element. That is, transfer passage 113 is defined by one principal straight-line boundary 114 coinciding with tangent line 111 and another principal curved boundary 115 corresponding to a partial tracing of outer surface edge 82 of wrap 78 of the stationary scroll member when the scroll members are oriented to achieve the maximum of four points of contact as shown in FIG. 8. These principal boundaries are likewise joined through blending radii 116.

An outer arcuate recessed liquid transfer passage 120, corresponding to outer recessed passage 100 of the stationary scroll member, is cut in inner surface 109 of end plate 105. As shown in FIG. 7, transfer passage 120 has a principal inner boundary 121 conforming in configuration to a partial tracing of inner surface edge 83 of involute wrap 78 of the stationary scroll member when the two scroll members are oriented as in FIG. 8. The principal boundary 122 of transfer passage 120 has the same contour as boundary 121 and the passage is closed by blending radii 123. Passage 120 is configured and sized to correspond to recess passage 100 of the stationary scroll member.

As previously noted, it is necessary to provide in a scroll liquid pump a porting system which permits the pump to run quietly, smoothly and free of pressure pulsations. The pump of this invention incorporates the unique porting system disclosed in Ser. No. 807,413. Although the preferred embodiment of the porting system as shown in FIGS. 6–17 is one which includes both inner and outer recessed liquid transfer passages, it is also within the scope of this invention to use the other embodiments described in Ser. No. 807,413, namely one which employs only inner or outer recessed passages as shown in FIGS. 1–4 and 21–24 of that copending application.

The manner by which the porting system of the scroll members of FIGS. 6 and 7 achieves essentially pulsation-free liquid pumping may be detailed with reference to FIGS. 8–17 which illustrate the operation of the scroll pump of this invention in which the liquid flows radially outward. FIGS. 8–17 illustrate various positions of the scroll members during one pumping cycle, the even-numbered figures being cross sections of the wraps taken transverse to the center line of the apparatus and the odd-numbered figures following them being the corresponding longitudinal cross sections through the wraps. Although it would not be normal to see the outlines of the recessed transfer passages 113 and 120 of the orbiting scroll member in those cross sectional drawings taken transverse to the center line (e.g., FIGS. 8, 10, etc.) these outlines have been dotted in to provide the location of the transverse passages in the accompanying longitudinal cross sections (e.g., FIGS. 9, 11, etc.). Boss 87 of the stationary scroll element has been eliminated and central inlet passage 89 has been drawn with a uniform cross section in the longitudinal cross sectional drawings of FIGS. 9, 10, etc. for the sake of simplicity.

In the operation of the scroll pump, the orbiting scroll member 76 is driven to orbit (by means described below in detail with reference to FIGS. 5 and 19) the stationary scroll member 75, the flank surfaces 82 and 83 and 108 and 109 of the stationary and orbiting scroll members making moving line contacts. The end surfaces 84 and 110 of the stationary and orbiting scroll members in making contact with the inner surfaces 107 and 79 of the orbiting and stationary scroll members, respectively, define the moving pockets 130, 131 and 132 (FIG. 8), the volumes of which and liquid communication between which change to effect the movement of the liquid through the pump. As will be seen in FIG. 5, the peripheral discharge zone 133 of the pump surrounds the scroll involute wraps and extends around the end plate of the orbiting scroll member. In FIGS. 8–17 this discharge zone is indicated without its boundaries.

Because liquids have much higher viscosities than gases and because the volume ratio within the pump is one rather than greater than one, the need for efficient radial sealing across contacting surfaces 84 and 110 of the wraps from pocket to pocket is not particularly stringent. As will be detailed below in describing the operation of the pump, the back pressure of the liquid flowing through the pump is sufficient to provide the axial forces required to urge the wraps and end plates into contact. Moreover, the outward radial flow of liquid through the pump provides hydraulic pressures within the pump to urge the flanks of the wraps of the scroll members into sealing arrangement as they make moving line contacts.

Figure 9:
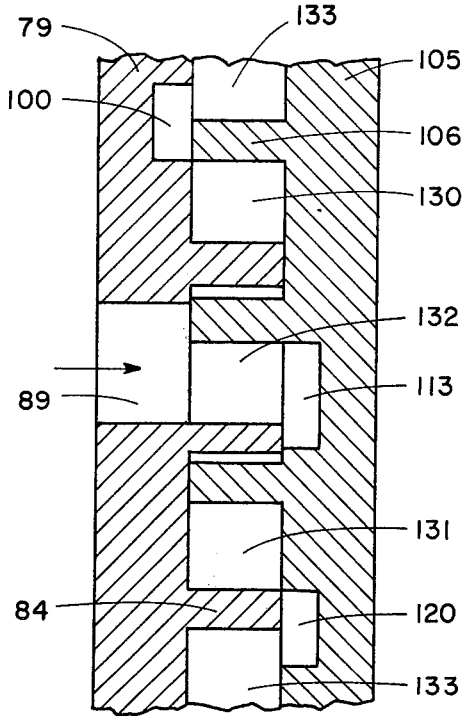
Figure 10:
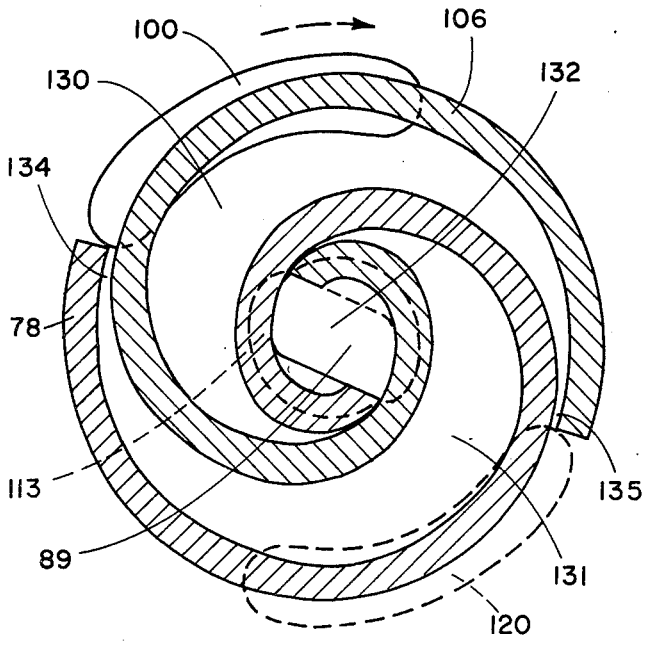
Figure 11:
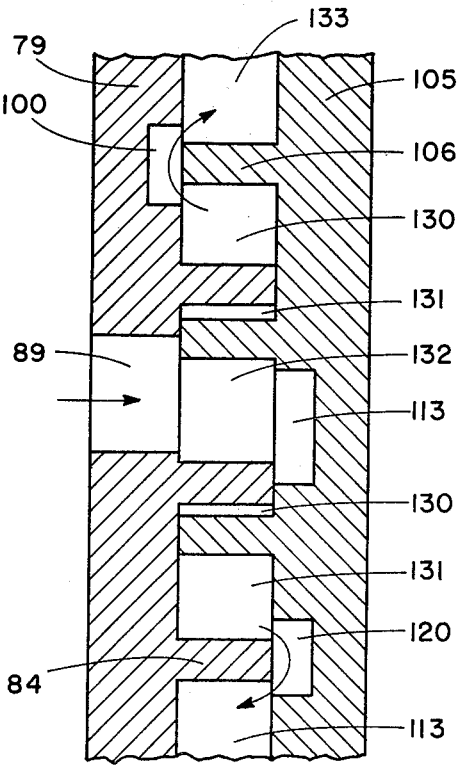
Figure 12:
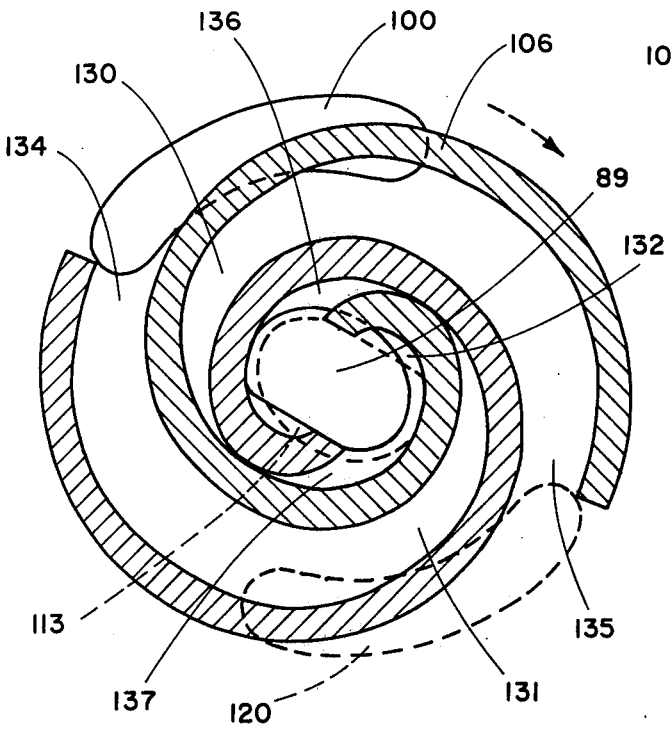
Figure 13:
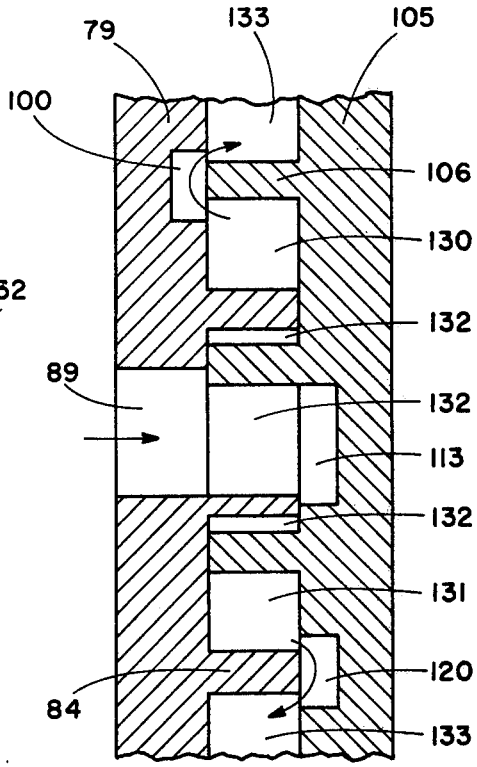

To describe the pumping action of the scroll members having the porting system shown, it is assumed that the cycle begins with the sealing off of center pocket 132 at which point pockets 130 and 131 are also sealed off (FIGS. 8 and 9). Assuming first that there were no arcuate recessed transfer passages 101 and 120 in end plates 79 and 105, it will be seen that the liquid in pockets 130 and 131 would be subjected to constantly changing pressure as the orbiting scroll is driven in the direction indicated by the broken arrows in the even-numbered figures. This is due to the fact that the openings 134 and 135 (FIG. 10), created by the movement of the orbiting scroll wrap 106 relative to the stationary scroll wrap 78 are not large enough to permit the flow of the liquid from pockets 130 and 131 into peripheral discharge zone 133 at a rate to prevent excessive pressure changes of the liquid in pockets 130 and 131. The result is the development of pressure pulsations and eventual damage to the scroll hardware.

When, however, recessed transfer passages 101 and 120 are present, there are provided, essentially instantaneously after the closing of pockets 130, 131 and 132, additional liquid flow passages. Thus transfer passages 100 and 120 augment passages 134 and 135, created by the movement of the orbiting scroll wrap relative to the stationary scroll wrap, and eliminate undue pressurization of the liquid which in turn gives rise to pressure pulsations. This becomes immediately apparent from an examination of FIGS. 10 and 11 which represent the position of the wraps with respect to the transfer passages immediately after the beginning of the orbit of the orbiting scroll member. It will be seen that transfer passages 100 and 120 provide almost instantaneous liquid communication between pockets 130 and 131 and peripheral discharge zone 133 as indicated by the arrows in FIG. 11.

Transfer passages 100 and 120 are closed by the time the orbiting scroll member has completed about three-eights of its orbit (a point midway between the scroll positions shown in FIGS. 12 and 14), for by this time they are no longer needed to augment liquid passages 134 and 135 which have reached near maximum. Central pocket 132, of course, encompasses more and more of the volume previously part of pockets 130 and 131, a fact that effects sufficient control of the liquid pressure within central pocket 132 as additional liquid is taken in. It will be appreciated from the drawings that as the cycle proceeds, the pockets as numbered and designated in FIGS. 12–17 become less and less sharply defined, a portion of each of pockets 130 and 131 becoming indistinguishable from central pocket 132. However, for clarity, the reference numerals of FIGS. 8 and 9 are used throughout FIGS. 10–17 and in the description of these drawings.

Figure 14:
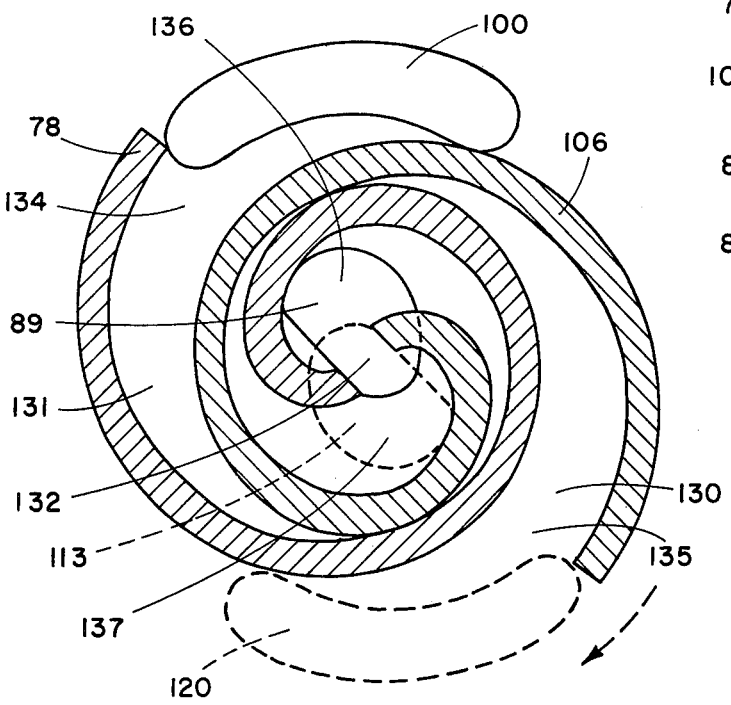
Figure 15:
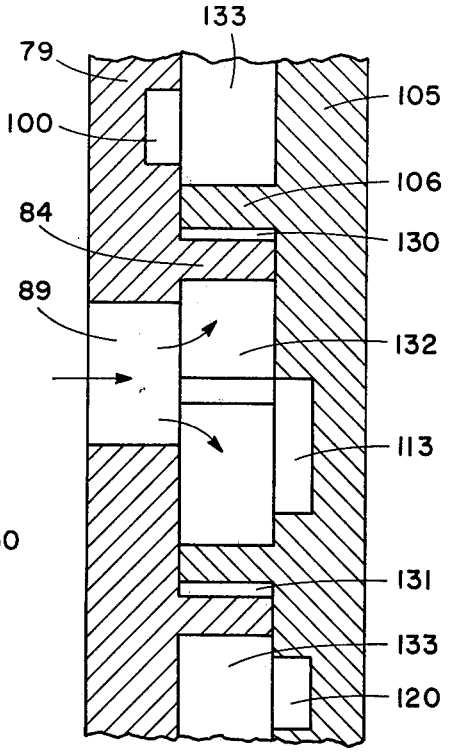

Passages 134 and 135 between the wraps 78 and 106 remain at their essentially maximum dimension as the pumping continues through three-fourths of the cycle as shown in FIGS. 14 and 15. This permits transfer passages 100 and 120 to remain effectively closed, i.e., inoperative. Finally, through the last quarter of the cycle (FIGS. 16 and 17) the small volume of liquid remaining in pockets 130 and 131 is transferred to peripheral discharge zone 133; and at the end of the cycle passages 134 and 135 are closed. With the completion of the cycle, the pockets 130, 131 and 132 are sealed off as shown in FIG. 8 to be in position to begin another cycle.

From the above description of the working of the outer recessed transfer passages of the porting system it will be seen that these recessed liquid transfer passage means are located and configured to be opened substantially immediately after the orbiting involute wrap has reached that point in its orbiting cycle to define three essentially completely sealed-off liquid pockets and to remain open at least until the liquid passages defined by the movement of the orbiting wrap and providing liquid communication into the peripheral liquid discharge zone are sufficiently large to prevent any substantial pressure pulsation within the scroll pump.

Figure 16:
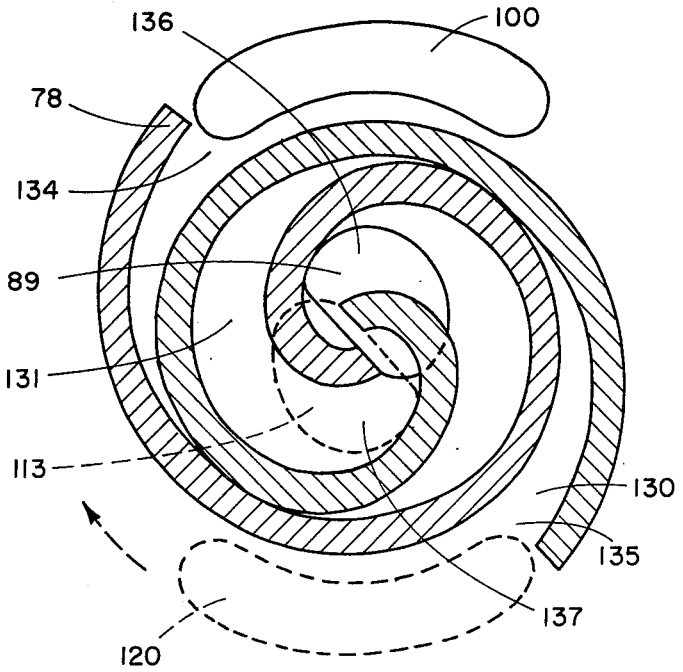
Figure 17:
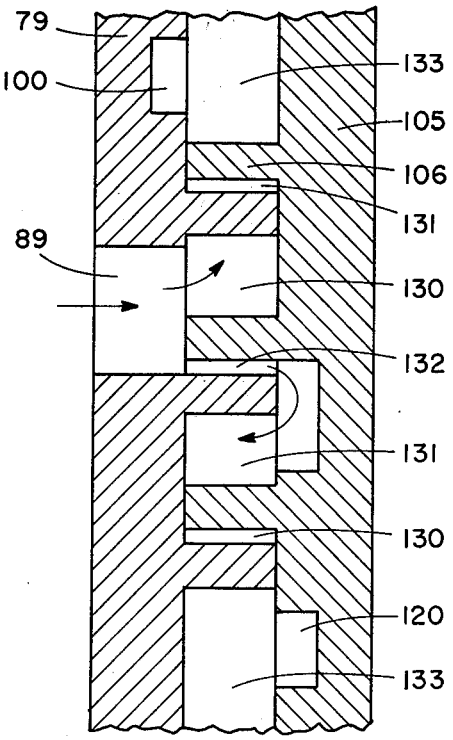

During the first period of the cycle when the outer recessed transfer passages 100 and 120 are augmenting the wrap-defined passages 134 and 135, the inner transfer passages (inlet 89 and orbiting scroll member recessed passage 113) are essentially inoperative since the introduction of liquid into the central zone and the flow of liquid radially outward into pockets 130 and 131 proceeds smoothly. As the cycle advances, however, the flow of liquid into the central zone gradually causes the differentiation among pockets 130, 131 and 132 and the presence of inner transfer passages 89 and 113 provides for a smooth flow of liquid into these forming pockets with minimal pressure drop. This situation continues (FIGS. 14–17); and as the center wrap passages 136 and 137 continue to decrease, the role of the open center transfer passages 89 and 113 becomes more important in insuring a smooth nonpulsating flow of liquid through inlet port 89 and center pocket 132 into pockets 130 and 131. With the closing of these pockets as indicated in FIGs. 16 and 17, the scroll wraps have been brought around through another cycle and are in a position to discharge liquid to the peripheral volume 133 with the reopening of peripheral transfer passages 100 and 120. Thus in this manner smooth pulsation-free liquid flow is assured through the scroll pump to achieve efficient reliable operation over an extended period of time.

Figure 18:
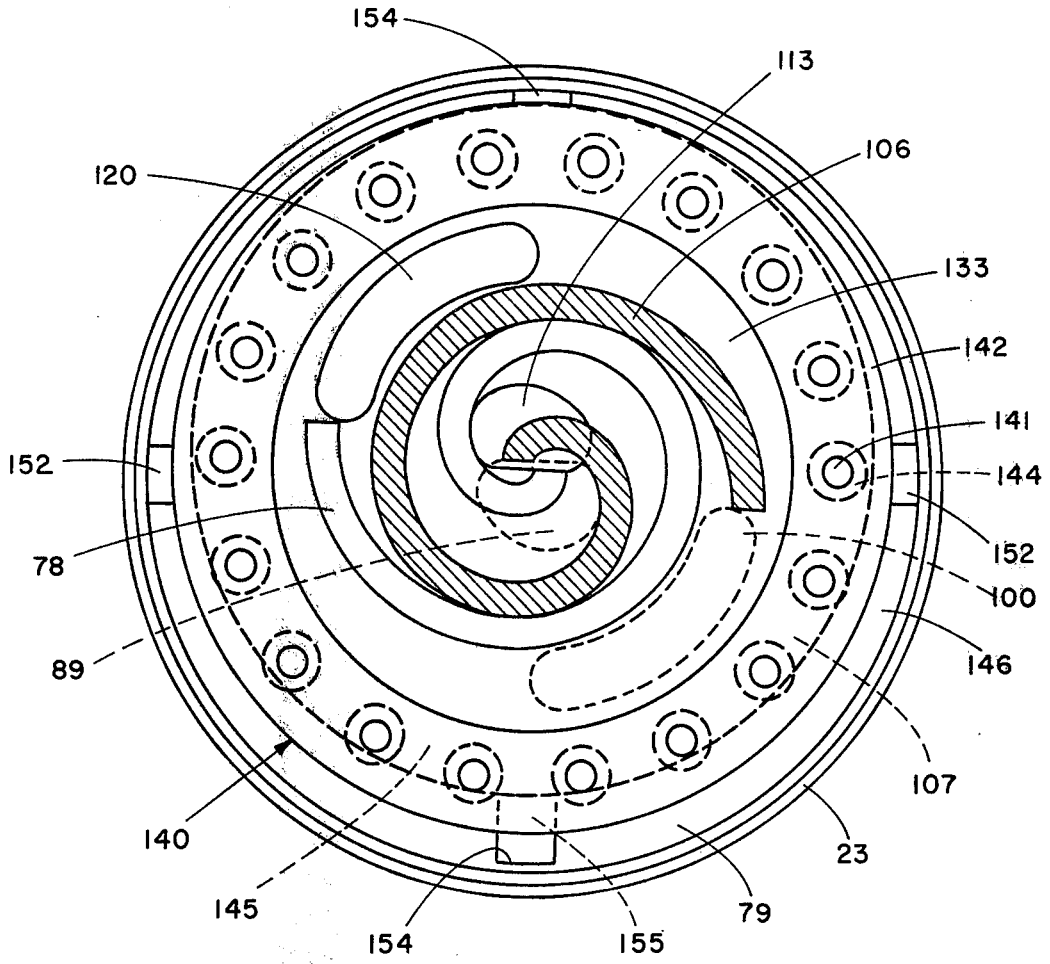
FIG. 18 is a cross sectional view of the pump of FIG. 5 taken transverse to the machine axis through plane 18—18 of FIG. 5.
Figure 19:
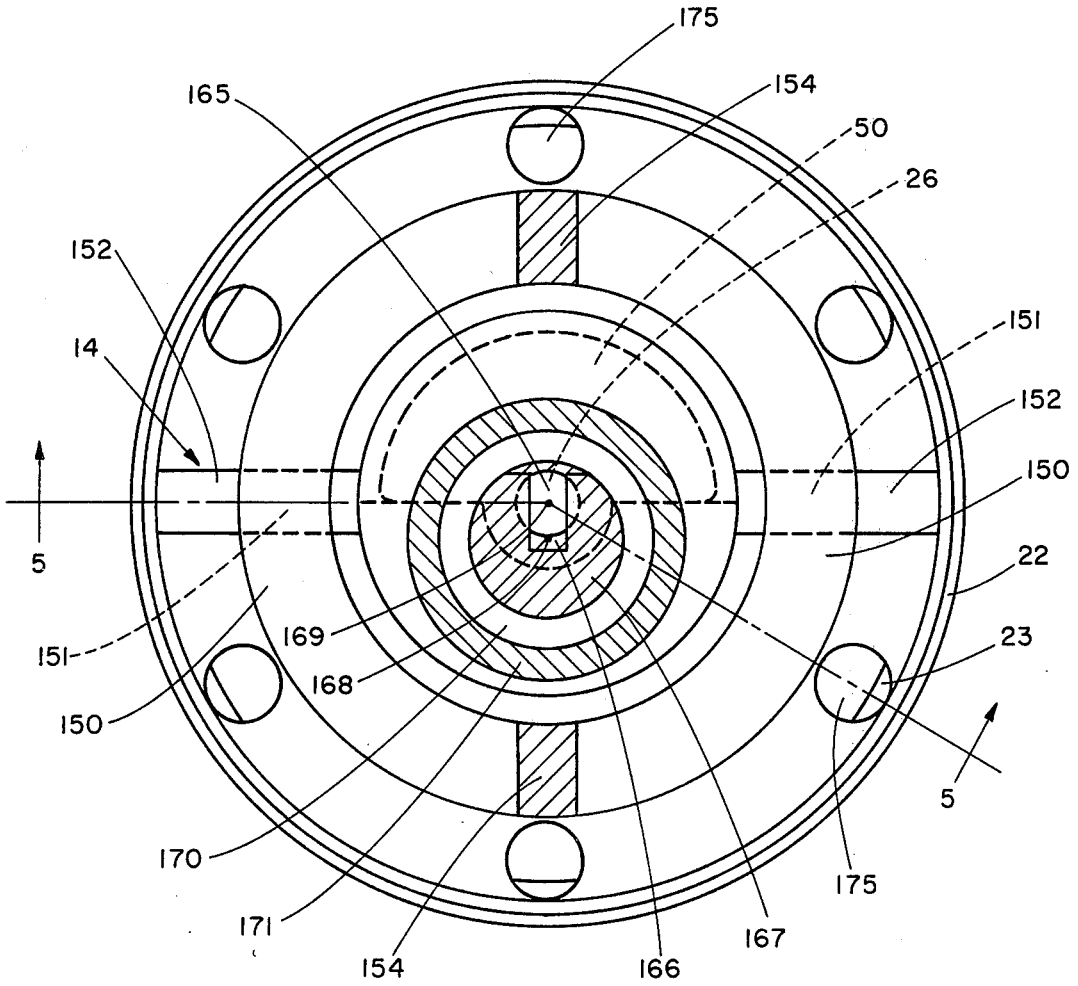
FIG. 19 is a cross sectional view of the pump of FIG. 5 taken transverse to the machine axis through plane 19—19 of FIG. 5.

The driving means, axial compressive load carrying means and coupling means are illustrated in FIGS. 5, 18 and 19. In the embodiment shown in these figures, the axial compressive load carrying means comprises a ball thrust bearing generally indicated by the reference numeral 140 and formed of a plurality of ball bearings 141 retained in the desired spaced relationship by two parallel ball retaining rings 142 and 143 having a plurality of equally spaced holes 144 configured to seat the balls 141. Retaining rings 142 and 143 are held in spaced relation by contact with the surface of balls 141 to define therebetween a plurality of radial liquid passages 145 through which the liquid flows from the peripheral pump discharge zone 133 into the scroll pump chamber 146. The major load on the scroll members is the compressive load generated by the liquid discharge pressure, and it is carried by the ball thrust bearing 140 as the axial load carrying means. Wear of the scroll members is thus minimized, thus giving rise to long pump life. Because of the ability of the axial load carrying means to maintain wear on the scroll members at a minimum it is possible to operate the pump of this invention with a relatively high discharge pressure, a fact which in turn gives rise to the attainment of good scroll sealing with high efficiency and hence minimal power consumption.

In operation, the two scroll members 75 and 76 must be maintained in a fixed angular relationship, and this is done through the use of the coupling member generally indicated in FIG. 5 by the numeral 14. The coupling member 14 illustrated in FIGS. 5 and 19 is essentially the same as the coupling member described in U.S. Pat. No. 3,994,633 (see FIG. 14 of that patent and the detailed description thereof). Thus as seen in FIGS. 5 and 19, the coupling member comprises a ring 150 having oppositely disposed keys 151 on one side thereof slidingly engaging keyways 152 in the inner surface of annular section 153 of bearing housing 23. (It will be appreciated that the longitudinal cross section of FIG. 5 is cut through the angled plane 5—5 of FIG. 19, and thus only one of the two oppositely disposed keys 151 and keyways 152 are illustrated (cf. FIG. 1).) A second pair of keys 154 oriented by 90° from keys 151 are oppositely disposed on the other side of coupling ring 150 to slidingly engage keyways 155 in end plate 105 of the orbiting scroll member 76. The coupling member 14 also serves as a spring to provide initial axial preloading on the orbiting scroll member during startup of the pump.

As described below in conjunction with FIGS. 23–28, it is possible to combine the functions of the axial load carrying means and the coupling means in one apparatus component.

The orbiting scroll member driving means are detailed in FIGS. 5 and 19. As will be seen in FIG. 5, drive shaft 26 is supported in main shaft bearing 160 held in shaft bearing housing 161 which, in turn, is integral with outer main bearing housing 23 through outer annular ring section 153, inner bearing housing 162 and inner ring section 163. Drive shaft 26 terminates in a flat stub shaft 165 which engages a keyway 166 (FIG. 19) in orbiting scroll drive yoke 167. This arrangement permits the orbiting scroll to move outward, urged by centrifugal and hydraulic forces, until its involute wrap is in contact with the involute wrap of the stationary scroll member. In this position the center 168 of yoke 167 is spaced from the center 169 of drive shaft 26 by a distance equal to the orbit radius of the orbiting scroll member. Drive yoke 167 is mounted in scroll drive bearing 170 supported in scroll drive bearing support ring 171 which is integral with the outer surface 172 of orbiting scroll member 76.

This scroll driving means provides an all-metal path (drive yoke 167, stub shaft 165 and drive shaft 26) for conducting heat away from the scroll drive bearing 170 during those periods when the pump in running dry, i.e., when the liquid in which it is normally immersed has been pumped out. The driving means is also designed to minimize friction losses through the placement of the bearings which minimizes the overturning moment on the orbiting scroll member and the loads on the motor bearings. This arrangement enhances pump efficiency and pump life as well as its dry running capability.

As will be seen in FIGS. 5 and 19, outer annular bearing housing ring 153 has a number of equally spaced liquid ports 175 permitting the liquid to flow from peripheral discharge zone 133 through scroll pump chamber 146 into motor chamber 70.

Figure 20:
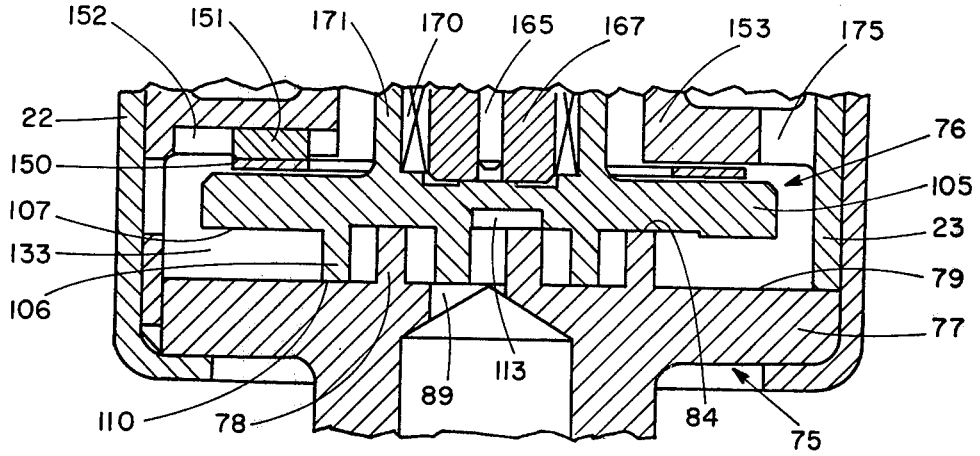
FIGS. 20, 21 and 22 illustrate three embodiments of the axial load carrying means of the pump of FIG. 5 (in addition to the embodiment illustrated in that figure) used in conjunction with a separate coupling member.

FIGS. 20–23, which are partial longitudinal cross sections of the inlet/scroll pump end of the pump, illustrate three additional embodiments of the axial load carrying means in pumps incorporating separate coupling means. In the embodiment of FIG. 20, the scroll members 75 and 76 themselves serve in the capacity of axial load carrying means with the contacting ends 84 and 110 of stationary scroll member and orbiting scroll member wraps 78 and 106, respectively, carrying the loads as they make contact with the facing surfaces of the end plates of the mating scroll members, i.e., surface 107 of orbiting end plate 105 and surface 79 of stationary end plate 77. The embodiment of FIG. 20 is generally better suited to those pumps requiring moderate discharge pressures.

Figure 21:
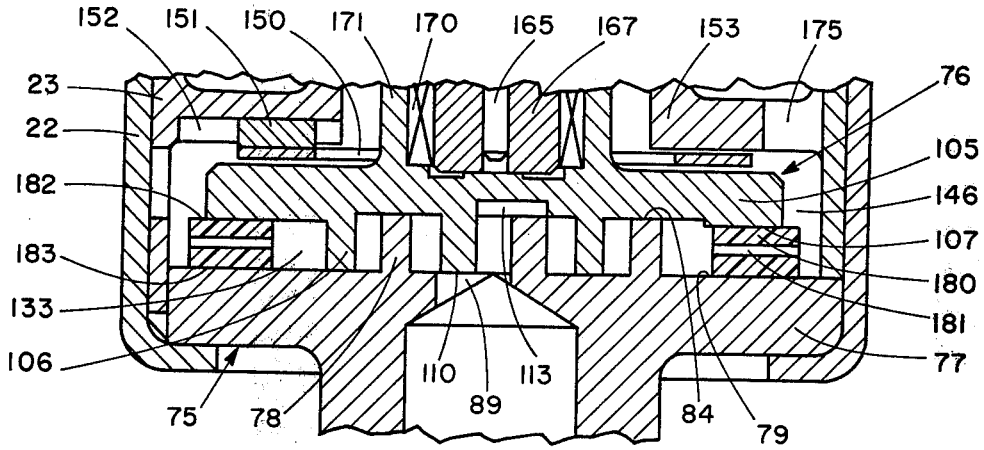

The axial load carrying means illustrated in FIG. 21 comprises an annular thrust bearing 180 having a plurality of radial passages 181 cut therethrough. The planar surfaces 182 and 183 of thrust bearing 180 make contact with the facing surfaces 79 and 105 of the stationary and orbiting scroll members, thus transmitting the axial compressive load of the pressurized liquid in the pump to this thrust bearing which is preferably formed of a synthetic organic plastic, e.g., a polyimide, in those pumps in which the scroll members are also formed of a synthetic plastic.

Figure 22:
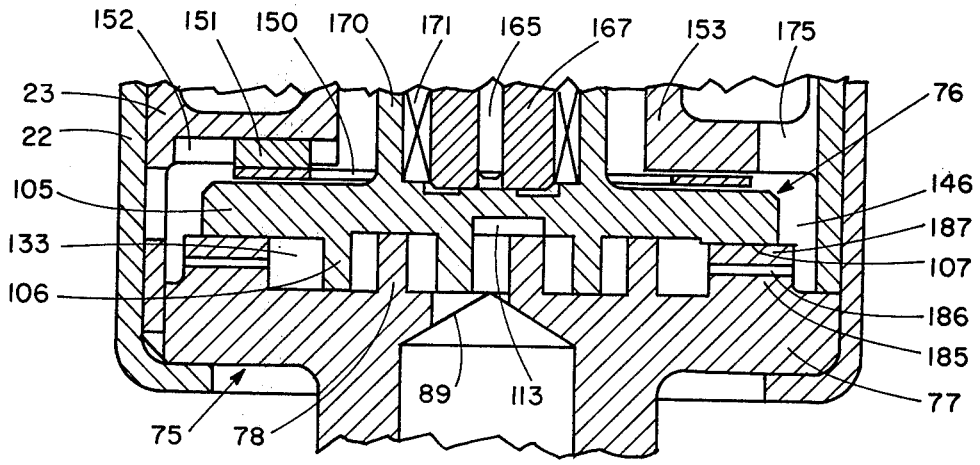

The embodiment of FIG. 22 is a modification of the embodiment of FIG. 21 in that an annular thrust bearing is used, but is formed as an annular ring extension 185 integral with inner surface 79 of stationary scroll member 75. A number of spaced radial passage 186 are cut in ring extension 185 to provide the necessary liquid communication between discharge zone 133 and pump chamber 146 and the axial load is carried by planar surface 187 making contact with orbiting scroll end plate surface 107.

Figure 23:
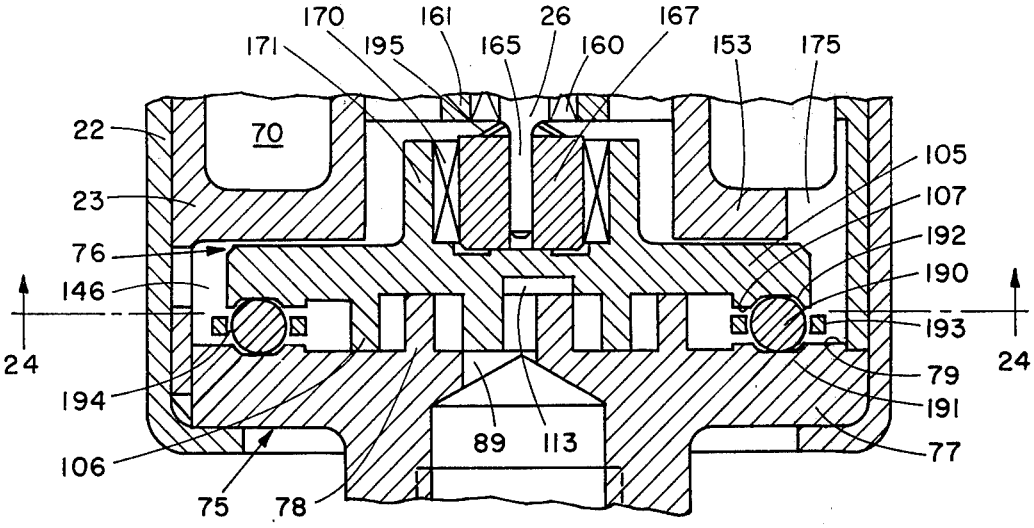
FIG. 23 illustrates one embodiment of an axial load carrying means and a coupling member combined in one apparatus component.

FIGS. 23–25 illustrate a modification of the pump of this invention in which the axial load carrying means serves also as the coupling means. The load carrying means comprise a plurality of equally spaced spheres 190 confined to a circular movement within circular indentations 191 and 192 in end plate surfaces 79 and 107 of the stationary and orbiting scroll members, respectively. The spheres 190 are maintained in radially and circumferential alignment by a sphere retainer ring 193 having holes 194 drilled therethrough. FIG. 24 illustrates in somewhat diagrammatic fashion the relative position of indentations 191 and 192 for the scroll element for one point in the orbit cycle. It will be seen from this figure that the centers of indentations 191 and 192 of the stationary and orbiting scroll members are located on circles having the same radius and are in axial alignment at that point of the cycle when the tangent lines (80, 81, 111 and 112 of FIGS. 6 and 7) of the two scroll members are all parallel.

The size of the indentations 191 and 192 relative to the diameter, $D_s$, of a sphere and the orbit radius, $R_o$, of the orbiting scroll member is shown diagrammatically in FIG. 25. In its movement during an orbiting cycle a sphere 190 must be able to travel a distance equal to one-half of the orbit radius, i.e., $R_o/2$, in all directions from its central position as shown in 25A. Thus it will be apparent that if the depth of an indentation 191 (or 192) were made equal to the sphere radius, $R_s$, the diameter, $D_i$, of the indentation must be $D_s + R_o$. Since, however, the depth of indentation 191 is less than $R_s$, it follows that $D_i$ should be slightly less than $D_s + R_o$. FIG. 25A illustrates one cross sectional configuration of the indentations and FIG. 25B a top plan view. It is also, however, within the scope of this invention to cut the indentation with the proper diameter as a straight-sided well with a chamfered edge.

FIG. 25C is an enlarged cross section of the indentations and retainer ring showing the manner in which the orbiting scroll member end plate 105 (and its attached involute wrap) is free to orbit within the stationary scroll member while being maintained in the desired angular relationship with respect to the stationary scroll member. The spheres 191 serve the same role as the multiball thrust bearing of FIG. 5 in carrying the compressive axial load on the scroll members and therefore the pump embodiment of FIGS. 23–25 exhibits the same advantageous performance characteristics as the embodiment of FIG. 5. In the absence of a separate coupling member, a spring washer 195 is provided between drive yoke 167 and the shoulder of shaft 26 to provide an axial preload on the scrolls during startup.

FIGS. 26–28 illustrate a modification of the pump of this invention in which the coupling means serves also in the capacity of a load carrying means. The coupling means, generally designated by the reference numeral 200, is placed between the end plates 77 and 105 of the stationary and orbiting scroll members. The coupling member is an annular ring 201 cut to have two oppositely disposed keys 202 for slidingly engaging keyways 203 cut in surface 107 of orbiting end plate 105 and two oppositely disposed keys 204, at right angles from keys 202, for slidingly engaging keyways 205 cut in surface 79 of stationary end plate 77. As will be seen in FIGS. 27 and 28, the coupling member has a series of equally spaced bearing pads 206 having planar surfaces 207 and 208 which engage facing scroll end plate surfaces 79 and 105, thus serving as the axial compressive load carrying means. Finally, the coupling member is cut to provide a plurality of liquid passages 209; and, as in the case of the modification of FIG. 23, a spring washer 195 is provided to provide an axial preload during startup.

In the pump embodiment shown in FIGS. 29–31 spherical members are used as both axial compressive load carrying means and as keys in the coupling means. The coupling member comprises an annular ring 225 configured with bearing pads 226 and liquid passages 227 as in the case of coupling ring 200 of FIGS. 26–28. There are, however, no keys on the coupling ring. A channel 228 is cut into the surface 229 of each bearing pad 226 which faces surface 107 of orbiting end plate 105. Channels 230 are cut in end plate surface 107 to correspond in configuration and axis orientation to channels 228 in the bearing pads; and a load carrying sphere 231 (bearing member) is positioned to experience coupling movement within each pair of the facing channels 228 and 230, the combined depth of which is slightly less than the diameter of spheres 231. Channels 228 and 230 have rim-to-rim lengths equal to or less than $D + R_o$ wherein D is the diameter of the spheres 231. In a similar manner, channels 234 and 235 (FIGS. 30 and 31) are cut into surface 236 of bearing pads 226 and in the facing surface 79 of end plate 77 of the stationary scroll member, and spheres 237 are positioned to experience coupling movement within each of these pairs of channels. The longitudinal axes of channels 234 and 235 are rotated 90° from the axes of channels 228 and 230. Thus spheres 231 and 237 carry the axial compressive load on the scroll members and also, in their restrained movement along the axes of the paired channels in which they are located, they maintain the required angular relationship between the orbiting and stationary scroll members.

The axial load carrying/coupling means shown in FIGS. 32–34 represent a modification of the means of FIGS. 29–31, in that rollers replace the spheres as the load carrying/coupling members. The coupling member is of the same general configuration as in FIGS. 29–31, being an annular ring 225 with bearing pads equally spaced therearound and liquid passages 227. The four bearing pads 240 which are spaced at 90° from each other have coupling means associated therewith; while the remaining bearing pads 241 serve only in an axial load-carrying capacity. The surfaces 242 of bearing pads 240, which face surface 107 of orbiting end plate 105, have channels 243 cut therein; and surface 107 likewise has four corresponding channels 244 cut in it, the two channels defining a closed track in which roller 245 can travel as shown by FIG. 34. The combined depth of channels 243 and 244 is slightly less than the diameter of roller 245, and the distance of roller travel is equivalent to the orbit radius ($R_o$). Bearing pads 240 also have channels 246 cut in surface 247 which faces surface 79 of end plate 77 of the stationary scroll member. Likewise surface 79 has four channels 248 corresponding to channels 246; and as shown in FIGS. 32 and 34, the channels 246 and 248 are oriented in respect to channels 243 and 244 so that rollers 249 traveling in channels 246 and 248 have axes at 90° from the axes of rollers 245. As in the case of spheres 231 and 237 of FIGS. 29 and 30, the rollers of the modification shown in FIGS. 32 and 33 serve both axial load carrying and coupling functions.

The use of the pump of this invention is illustrated in FIG. 35. The pump is immersed in the liquid 255 to be pumped, contained within a tank 256, e.g., the fuel tank of an automobile; and a high-pressure liquid line 257, attached to the discharge means 12 of the pump, is led out through suitable porting 258 in tank 256 to be connected to the desired liquid receptor, e.g., the carburetor of the automobile. Likewise, shielded electrical lines 259, connected to the screw terminals 29 are brought through porting 258 for connection to a source of electrical energy. A filter 260 is attached to the inlet means 11 of the pump to filter out any debris which may be in the liquid or settled on the bottom of the tank.

Pumps constructed in accordance with this invention are self-priming, and they are capable of operating dry for a relatively long period of time, e.g., ten minutes or longer, without loss of performance. These pumps operate with minimal noise, vibration and output flow variation, and they can ingest debris without permanent damage due to radial compliance of the drive system. The direction of liquid flow through the scroll members provides for self-actuating scroll sealing between the flanks of the scroll wraps; and for self-actuating radial scroll sealing. Thus in the pump of this invention it is not necessary to provide additional radial sealing means or to provide means to counteract any of the centrifugal forces acting upon the orbiting scroll members.

The unique liquid flow pattern through the pump, as shown by the arrows in FIG. 1, provides complete self-lubrication for all of the pump components, and eliminates the need for all valving except for the simple one-way valve associated with the liquid discharge means and the pressure relief valve.

The pump of this invention is particularly suited for placement in a fuel tank of an automobile. This is best illustrated by the fact that it can be made small enough to fit through an automobile fuel tank access opening ($1\frac{7}{8}$ inches (4.76 cm) maximum pump diameter) and to have a pumping capacity to deliver at least 185 pounds (84 kilograms) of fuel per hour at 12 psig (844 grams per square centimeter). Moreover, the scroll pump components may be formed (e.g., molded) from a suitable wear-resistant synthetic organic plastic and the remaining pump components may be mass produced from compatible plastics or metals, thus making it possible to meet the low-cost requirement for such immersible fuel pumps.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

We claim:

1. A liquid immersible self-lubricating and self-cooling pump, comprising in combination
   (a) housing means with liquid inlet and discharge means on opposite ends thereof;
   (b) scroll pump means comprising an orbiting scroll member with an end plate and an involute wrap and a stationary scroll member with an end plate and an involute wrap, said scroll pump means being positioned within said housing to receive liquid through said inlet means into a central scroll pump zone and discharge it at a predetermined pressure into a peripheral scroll pump discharge zone, said inlet means comprising a central liquid port in said end plate of said stationary scroll member, the configuration of said central port being defined along one principal boundary by a partial tracing of the edge of said wrap of said orbiting scroll member and along another principal boundary by a line coinciding with a straight line drawn as a tangent to the generating radius of said wrap of said stationary scroll member;
   (c) driving means within said housing arranged to drive said orbiting scroll member to experience orbiting motion with respect to said stationary scroll member; and
   (d) coupling means to maintain a predetermined angular relationship between said scroll members; the flow of liquid through said scroll pump and said housing means around said driving means and into said liquid discharge means being such as to effect (1) tangential sealing between said involute wraps making moving line contact as said orbiting scroll member is driven, and (2) axial sealing to prevent radial leakage between said end plates and said involute wraps of said scroll members, whereby said scroll pump means is essentially self-sealing.

2. A liquid immersible pump in accordance with claim 1 wherein said coupling means and said axial compressive load carrying means comprise a single component serving as a coupling/load carrying means.

3. A liquid immersible pump in accordance with claim 1 including primary counterweight means to counteract forces generated transverse to the axis of said pump and secondary counterweight means to cancel out moments generated by said primary counterweight means.

4. A liquid immersible pump in accordance with claim 1 wherein said driving means comprises
   (1) a drive shaft having an axis which coincides with the axis of said scroll pump means and terminating in a stub shaft having an axis coincident with said drive shaft axis; and (2) a drive yoke rotatable within said orbiting scroll member and slidingly keyed to said stub shaft; whereby, when said scroll pump means is running the center axis of said yoke is parallel to said drive shaft axis but spaced therefrom by a distance equal to the orbit radius of said orbiting scroll member.

5. A liquid immersible pump in accordance with claim 1 wherein said liquid discharge means comprises a discharge conduit extending through said housing means having associated therewith pressure-controlled one-way valve means arranged to permit liquid to be discharged when liquid pressure within said pump reaches a predetermined pressure.

6. A liquid immersible pump in accordance with claim 5 including pressure relief valve means.

7. A liquid immersible pump in accordance with claim 1 including axial compressive load carrying means.

8. A liquid immersible pump in accordance with claim 7 wherein said axial compressive load carrying means comprises ball thrust bearing means, the balls of which make moving contact with the facing surfaces of said stationary and orbiting end plates.

9. A liquid immersible scroll pump, comprising in combination (a) stationary and orbiting scroll members having, respectively, stationary and orbiting involute wraps and stationary and orbiting end plates presenting facing surfaces, said scroll members having porting means arranged to prevent the development of any appreciable pressure pulsations during pumping;

(b) housing means defining therein a chamber in which said stationary and orbiting scroll members are located and having liquid inlet means on one end thereof and liquid discharge means on the other end thereof, said liquid inlet means serving as one part of said porting means and comprising a central liquid port in said end plate of said stationary scroll member, the configuration of said central port being defined along one principal boundary by a partial tracing of the edge of said wrap of said orbiting scroll member and along another principal boundary by a line coinciding with a straight line drawn as a tangent to the generating radius of said wrap of said stationary scroll member;

(c) coupling means to maintain said stationary and orbiting scroll members in a predetermined angular relationship; and (d) driving means, including motor means for driving said orbiting scroll member, located within said chamber between said scroll members and said other end of said housing, whereby liquid pumped radially outward by said scroll members and through said pump flows around said driving means and maintains a predetermined hydraulic pressure within said chamber to provide axial loading on said scroll members.

10. A liquid immersible scroll pump in accordance with claim 9 including filter means affixed to said liquid inlet means.

11. A liquid immersible scroll pump in accordance with claim 9 wherein said liquid discharge means comprises a discharge conduit having associated therewith pressure-controlled one-way valve means arranged to permit liquid to be discharged from said chamber when liquid pressure within said pump reaches a predetermined level.

12. A liquid immersible scroll pump in accordance with claim 9 including pressure relief valve means.

13. A liquid immersible scroll pump in accordance with claim 9 including as part of said porting means a stationary recessed liquid transfer passage means which is located outside said stationary involute wrap, is of general arcuate configuration and is defined along one principal boundary by a partial tracing of said orbiting involute wrap edge and along another principal boundary by a line following the same contour as said one principal boundary and spaced radially outward therefrom.

14. A liquid immersible scroll pump in accordance with claim 9 including primary counterweight means to counteract forces generated transverse to the axis of said pump and secondary counterweight means to cancel out moments generated by said primary counterweight means.

15. A liquid immersible scroll pump in accordance with claim 9 wherein said driving means comprises a drive shaft terminating in a stub shaft, an orbiting scroll member drive yoke rotatable within said orbiting scroll member and slidably keyed to said stub shaft and bearing means associated with said shaft and said drive yoke, the axes of said shaft and said drive yoke being parallel and spaced apart when said pump is operating by a distance equal to the orbit radius of said orbiting scroll member.

16. A liquid immersible scroll pump in accordance with claim 15 wherein said motor means comprises an armature and commutator means mounted on said drive shaft, stator magnet means mounted on the internal wall of said housing means, brush means contacting said commutator means and terminal means extending external of said housing making electrical contact with said commutator means through said brush means.

17. A liquid immersible scroll pump in accordance with claim 9 wherein said stationary involute wrap has one and one-half involute turns and said orbiting scroll member has one and one-half involute turns and orbiting recessed liquid transfer passage means cut in said one surface of said orbiting end plate serving as another part of said porting means; whereby when said orbiting scroll member is driven by said driving means said stationary and said orbiting involute wraps define moving liquid pockets of variable volume and a peripheral discharge zone; said liquid inlet means and said orbiting recessed liquid transfer passage means being located and configured to be opened substantially immediately after said orbiting involute wrap has reached that point in its orbiting cycle to define three essentially completely sealed-off liquid pockets and to remain open at least until the liquid passages defined by the orbiting of said orbiting wrap and providing liquid communication into said liquid discharge zone are sufficiently large to prevent any substantial pressure pulsations within the scroll liquid pump.

18. A liquid immersible scroll pump in accordance with claim 17 wherein said orbiting recessed liquid transfer passage means comprises (1) an inner recessed passage having as one principal boundary a first partial tracing of the edge of said wrap of said stationary scroll member and as another principal boundary a line coinciding with a straight line drawn as a tangent to the generating radius of said wrap of said orbiting scroll member, and (2) an outer recessed passage of general arcuate configuration having as one principal boundary a second partial tracing of the edge of said wrap of said stationary scroll member and as another principal boundary a line following the same contour as said one principal boundary and spaced radially outward therefrom.

19. A liquid immersible scroll pump in accordance with claim 9 including axial compressive load carrying means.

20. A liquid immersible scroll pump in accordance with claim 19 wherein said axial compressive load carrying means comprises ball thrust bearing means, the balls of which make moving contact with said facing surfaces of said stationary and orbiting end plates.

21. A liquid immersible scroll pump in accordance with claim 19 wherein said axial compressive load carrying means comprises an annular thrust bearing having oppositely disposed planar surfaces arranged to contact said facing surfaces of said stationary and orbiting end plates and a plurality of radial passages through said annular thrust bearing.

22. A liquid immersible scroll pump in accordance with claim 19 wherein said axial compressive load carrying means comprises an annular ring extension of said end plate of said stationary scroll member, said ring extension having a planar surface and being of a height such that said planar surface contacts said facing surface of said end plate of said orbiting scroll member, said ring extension having a plurality of radial passages therethrough.

23. A liquid immersible scroll pump in accordance with claim 19 wherein said coupling means and said axial compressive load carrying means comprise a single component serving as a coupling/load carrying means.

24. A liquid immersible scroll pump in accordance with claim 23 including axial force applying means for urging said orbiting scroll member into contact with said stationary scroll member during startup.

25. A liquid immersible scroll pump in accordance with claim 23 wherein said facing surfaces of said end plates of said stationary and orbiting scroll member have a plurality of radially and circumferentially aligned indentations, and wherein said coupling/load carrying means comprise a plurality of spheres each of which is confined to a circular movement within a pair of facing indentations and sphere-retaining ring means.

26. A liquid immersible scroll pump in accordance with claim 23 wherein said facing surfaces of said stationary and orbiting end plates each have two oppositely disposed keyways cut in them, said keyways in said orbiting scroll end plate being oriented 90° from said keyways in said stationary end plate, and wherein said coupling/load carrying means comprises a coupling ring member having two oppositely disposed keys on each side for slidingly engaging said keyways, said coupling ring member having spaced bearing pads to provide surfaces arranged to contact said facing surfaces of said scroll members and providing liquid passages between said bearing pads.

27. A liquid immersible scroll pump in accordance with claim 23 wherein said facing surfaces of said end plates of said orbiting and stationary scroll members have a plurality of end plate channels cut therein, the axes of said end plate channels in said end plate of said orbiting scroll member being oriented 90° from the axes of said end plate channels in said end plate of said stationary scroll member, and said coupling/load carrying means comprise an annular ring member having alternating bearing pads and liquid passages cut in both surfaces thereof, at least four equally spaced bearing pads having bearing pad channels cut therein in radial and circumferential alignment with said end plate channels to define bearing tracks with said end plate channels, and a bearing member capable of experiencing rolling motion in each of said bearing tracks along its axis.

28. A liquid immersible scroll pump in accordance with claim 27 wherein the combined depths of the end plate and bearing pad channels is slightly less than the diameter of said bearing member.

29. A liquid immersible scroll pump in accordance with claim 27 wherein said bearing member is a sphere.

30. A liquid immersible scroll pump in accordance with claim 27 wherein said bearing member is a roller.

31. A liquid immersible scroll pump, comprising in combination (a) housing means containing therein bearing housing means which divide the volume defined within said housing means into a motor chamber and a scroll pump chamber, said bearing housing means having a plurality of liquid passages providing liquid communication between said motor chamber and said scroll pump chamber;

(b) scroll pump means located within said scroll pump chamber and comprising in combination (1) a stationary scroll member having a central liquid port and comprising a stationary end plate, a stationary involute wrap of one and one-half involute turns affixed to one surface of said stationary end plate, and stationary recessed liquid transfer passage means cut in said one surface of said stationary end plate; and (2) an orbiting scroll member arranged to be orbited with respect to said stationary scroll member thereby to define within said scroll pump means moving liquid pockets and comprising an orbiting end plate, an orbiting involute wrap of one and one-half involute turns affixed to one surface of said orbiting end plate, said one surface of said stationary end plate facing said one surface of said orbiting end plate, and orbiting recessed liquid transfer passage means cut in said one surface of said orbiting end plate;

(c) coupling means to maintain said stationary and orbiting scroll members in a predetermined angular relationship;

(d) liquid inlet means arranged to deliver liquid to be pumped into the central liquid pocket of said scroll pump means;

(e) liquid discharge means arranged to discharge said liquid from said motor chamber under a controlled predetermined pressure;

(f) orbiting scroll member driving means, including electric motor means, comprising a drive shaft having an axis which coincides with the axis of said pump and which extends through said bearing housing means, said drive shaft terminating in a stub shaft having an axis coincident with said drive shaft axis;

(g) a drive yoke rotatable within said orbiting scroll member and slidably keyed to said stub shaft whereby, when said pump is running the center axis of said yoke is parallel to said drive shaft axis but spaced therefrom by a distance equal to the orbit radius of said orbiting scroll member; and (h) counterweight means affixed to said drive shaft.

32. A liquid immersible scroll pump in accordance with claim 31 wherein said stationary recessed liquid transfer passage means is located outside said stationary involute wrap, is of general arcuate configuration and is defined along one principal boundary by a partial tracing of said orbiting involute wrap edge and along another principal boundary by a line following the same contour as said one principal boundary and spaced radially outward therefrom.

33. A liquid immersible scroll pump in accordance with claim 31 wherein said orbiting recessed liquid transfer passage means comprises (1) an inner recessed passage having as one principal boundary a first partial tracing of the edge of said wrap of said stationary scroll member and as another principal boundary a line coinciding with a straight line drawn as a tangent to the generating radius of said wrap of said orbiting scroll member, and (2) an outer recessed passage of general arcuate configuration having as one principal boundary a second partial tracing of the edge of said wrap of said stationary scroll member and as another principal boundary a line following the same contour as said one principal boundary and spaced radially outward therefrom.

34. A liquid immersible scroll pump in accordance with claim 31 wherein said bearing housing means has two oppositely disposed housing keyways cut in a surface thereof and the surface of said orbiting end plate facing said bearing housing means has two oppositely disposed scroll keyways, oriented 90° from said housing keyways, cut therein; and said coupling means comprises an annular ring with oppositely disposed keys on each side thereof arranged to slidingly engage said housing and scroll keyways.

35. A liquid immersible pump in accordance with claim 31 wherein said stub shaft and said drive yoke are formed of metal and make metal-to-metal contact thereby to provide an effective heat transfer path for heat developed in said orbiting scroll member driving means, particularly when said pump is running dry.

36. A liquid immersible pump in accordance with claim 31 wherein said counterweight means comprise a primary counterweight to counteract forces generated transverse to the axis of said pump and a secondary counterweight to cancel out moments generated by said primary counterweight.

37. A liquid immersible scroll pump in accordance with claim 31 wherein said motor means comprises an armature and commutator means mounted on said drive shaft, stator magnet means mounted on the internal wall of said housing means, brush means contacting said commutator means and terminal means extending external of said housing means making electrical contact with said commutator means through said brush means.

38. A liquid immersible scroll pump in accordance with claim 31 wherein said housing means comprises, in combination (a) a central cylindrical section having an inlet and a discharge end;

(b) said stationary end plate mounted in and sealing said inlet end of said cylindrical section; and (c) a discharge end block mounted in and sealing said discharge end of said cylindrical section.

39. A liquid immersible scroll pump in accordance with claim 38 wherein said inlet means comprises a central boss integral with the external surface of said stationary end plate defining a liquid inlet conduit which terminates in a central liquid port in said end plate, the configuration of said central port being defined along one principal boundary by a partial tracing of the edge of said wrap of said orbiting scroll member and along another principal boundary by a line coinciding with a straight line drawn as a tangent to the generating radius of said wrap of said stationary scroll member.

40. A liquid immersible scroll pump in accordance with claim 38 wherein said liquid discharge means comprises a discharge conduit extending through said end blocks having associated therewith pressure-controlled one-way valve means arranged to permit liquid to be discharged from said chamber when liquid pressure within said pump reaches said predetermined pressure.

41. A liquid immersible scroll pump in accordance with claim 40 including pressure relief valve means.

42. A liquid immersible scroll pump in accordance with claim 31 including axial compressive load carrying means.

43. A liquid immersible scroll pump in accordance with claim 42 wherein said axial compressive load carrying means comprises ball thrust bearing means, the balls of which make moving contact with said facing surfaces of said stationary and orbiting end plates.

44. A liquid immersible scroll pump in accordance with claim 42 wherein said axial compressive load carrying means comprises an annular thrust bearing having oppositely disposed planar surfaces arranged to contact said facing surfaces of said stationary and orbiting end plates and a plurality of radial passages through said annular thrust bearing.

45. A liquid immersible scroll pump in accordance with claim 42 wherein said axial compressive load carrying means comprises an annular ring extension of said end plate of said stationary scroll member, said ring extension having a planar surface and being of a height such that said planar surface contacts said facing surface of said end plate of said orbiting scroll member, said ring extension having a plurality of radial passages therethrough.

46. A liquid immersible scroll pump in accordance with claim 42 wherein said coupling means and said axial compressive load carrying means comprise a single component serving as a coupling/load carrying means.

47. A liquid immersible scroll pump in accordance with claim 46 including axial force applying means for urging said orbiting scroll member into contact with said stationary scroll member during startup.

48. A liquid immersible scroll pump in accordance with claim 46 wherein said facing surfaces of said end plates of said stationary and orbiting scroll members have a plurality of radially and circumferentially aligned indentations, and wherein said coupling/load carrying means comprise a plurality of spheres each one of which is confined to a circular movement within a pair of facing indentations, and sphere retaining ring means.

49. A liquid immersible scroll pump in accordance with claim 46 wherein said facing surfaces of said stationary and orbiting end plates each have two oppositely disposed keyways cut in them, said keyways in said orbiting scroll end plate being oriented 90° from said keyways in said stationary end plate, and wherein said coupling/load carrying means comprises a coupling ring member having two oppositely disposed keys on each side for slidingly engaging said keyways, said coupling ring member having spaced bearing pads to provide surfaces arranged to contact said facing sufaces of said scroll members and providing liquid passages between said bearing pads.

50. A liquid immersible scroll pump in accordance with claim 46 wherein said facing surfaces of said end plates of said orbiting and stationary scroll members have a plurality of end plate channels cut therein, the axes of said end plate channels in said end plate of said orbiting scroll member being oriented 90° from the axes of said end plate channels in said end plate of said stationary scroll member, and said coupling/load carrying means comprise an annular ring member having alternating bearing pads and liquid passages cut in both surfaces thereof, at least four equally spaced bearing pads having bearing pad channels cut therein in radial and circumferential alignment with said end plate channels to define bearing tracks with said end plate channels, and a bearing member capable of experiencing rolling motion in each of said bearing tracks along its axis.

51. A liquid immersible scroll pump in accordance with claim 50 wherein the combined depths of the end plate and bearing pad channels is slightly less than the diameter of said bearing member.

52. A liquid immersible scroll pump in accordance with claim 50 wherein said bearing member is a sphere.

53. A liquid immersible scroll pump in accordance with claim 50 wherein said bearing member is a roller.

* * * * *